US007549743B2

(12) United States Patent
Huxlin et al.

(10) Patent No.: US 7,549,743 B2
(45) Date of Patent: Jun. 23, 2009

(54) SYSTEMS AND METHODS FOR IMPROVING VISUAL DISCRIMINATION

(75) Inventors: Krystel R. Huxlin, Rush, NY (US); Mary M. Hayhoe, Austin, TX (US); Jeff B. Pelz, Pittsford, NY (US)

(73) Assignee: University of Rochester, Rochester, NY (US)

( * ) Notice: Subject to any disclaimer, the term of this patent is extended or adjusted under 35 U.S.C. 154(b) by 0 days.

(21) Appl. No.: 11/794,883

(22) PCT Filed: Jan. 6, 2006

(86) PCT No.: PCT/US2006/000655

§ 371 (c)(1),
(2), (4) Date: Mar. 10, 2008

(87) PCT Pub. No.: WO2006/074434

PCT Pub. Date: Jul. 13, 2006

(65) Prior Publication Data

US 2008/0278682 A1 Nov. 13, 2008

Related U.S. Application Data

(60) Provisional application No. 60/641,589, filed on Jan. 6, 2005, provisional application No. 60/647,619, filed on Jan. 26, 2005, provisional application No. 60/665,909, filed on Mar. 28, 2005.

(51) Int. Cl.
*A61B 3/00* (2006.01)

(52) U.S. Cl. ..... 351/203; 351/246

(58) Field of Classification Search ..... 351/200, 351/203, 222, 224, 226, 237, 239, 246
See application file for complete search history.

(56) References Cited

U.S. PATENT DOCUMENTS

| | | | | |
|---|---|---|---|---|
| 4,634,243 | A | 1/1987 | Massof et al. | |
| 4,995,717 | A * | 2/1991 | Damato | 351/224 |
| 5,412,561 | A | 5/1995 | Rosenshein et al. | |
| 5,589,897 | A * | 12/1996 | Sinclair et al. | 351/223 |
| 6,260,970 | B1 | 7/2001 | Horn | |
| 6,386,706 | B1 | 5/2002 | McClure et al. | |
| 6,464,356 | B1 | 10/2002 | Sabel et al. | |
| 6,736,511 | B2 | 5/2004 | Plummer et al. | |

* cited by examiner

*Primary Examiner*—Ricky L Mack
*Assistant Examiner*—Dawayne A Pinkney
(74) *Attorney, Agent, or Firm*—McDermott Will & Emery LLP; James W. Hill

(57) ABSTRACT

A system and method for retraining the visual system of a subject with damage to the striate and/or extrastriate visual cortex includes displaying a visual stimulus within a first location of an impaired visual field of the subject; and detecting the subject's perception of an attribute of the visual stimulus. The system and method are believed to effectively recruit undamaged higher level structures in the visual system to assume the functions of the damaged structures.

23 Claims, 15 Drawing Sheets

A B

*Patient 1*

| | Direction range thresholds (deg) | | |
|---|---|---|---|
| | E | F | G |
| Before training | 0 | 0 | 0 |
| After training at E | 266 ± 20 | 0 | 0 |
| After training at F | 264 | 273 ± 17 | 0 |
| After training at G | 280 | 279 | 255 ± 19 |

| Visual Field Quadrant | % Balls detected (# det. /# total) Before Training | After Training |
|---|---|---|
| Upper Left | 100% (3/3) | 100% (4/4) |
| Upper Right | 0% (0/6) | 80% (8/10) |
| Lower Left | 100% (11/11) | 100% (6/6) |
| Lower Right | 0% (0/4) | 0% (0/5) |

SYSTEMS AND METHODS FOR IMPROVING VISUAL DISCRIMINATION

RELATED APPLICATIONS

This application is a U.S. national phase application under 35 U.S.C. § 371 based on PCT Application No. PCT/US2006/000655, filed Jan. 6, 2006, and claims the benefit under §§ 119 and 365 from U.S. Provisional Patent Application No. 60/641,589, filed on Jan. 6, 2005, U.S. Provisional Patent Application No. 60/647,619, filed on Jan. 26, 2005, and U.S. Provisional Patent Application No. 60/665,909, filed Mar. 28, 2005, each of which is hereby incorporated herein by reference in its entirety.

BACKGROUND

1. Field of the Inventions

Embodiments of the present disclosure relate generally to the computerized training and/or evaluation of visual discrimination abilities, and more particularly, to retraining and evaluation of patients with damage to the visual system.

2. Description of the Related Art

Damage to the striate and/or extrastriate visual cortex often results in the impairment or loss of conscious vision in one or more portions of the visual field. For example, damage to the primary visual cortex, V1, for example, by stroke or trauma, can result in homonymous hemianopia, the loss of conscious vision over half of the visual field. Patients with visual cortical damage are either sent home or to "low vision" clinics where they are trained to improve their compensatory mechanisms rather than to attempt recovery of lost vision. This is in sharp contrast with the physical therapy aggressively implemented to rehabilitate patients with motor abnormalities resulting from damage to motor cortex. Among the reasons for this discrepancy are: (1) the inadequacy of common clinical tests to identify many of the specific visual dysfunction(s) resulting from cortical damage, and (2) the widespread belief in the clinical setting, that lost visual functions cannot be recovered in adulthood. See, for example, Commentary Horton J. C. (2005) *Br. J. Ophthalmol.* 89: 1-2, incorporated herein by reference.

SUMMARY

The only system for retraining vision in people with post-chiasmatic damage to the visual system is the NovaVision VRT™ Visual Restoration Therapy™ (NovaVision, Boca Raton, Fla.). This system uses very simple visual stimuli (spots of light on a dark screen) and requires the patients to do a simple detection task rather than a discrimination task. This approach is most likely to stimulate lower levels of the visual system, including and up to primary visual cortex, but it is not normally an effective stimulus for higher level visual cortical areas. The NovaVision VRT results in improvements in the size of the visual field on the order of about 5° visual angle, on average. This is a relatively modest improvement, and consequently, the NovaVision VRT works best in people with significant sparing of vision. In addition, in published reports using this system, it is hard to determine if visual improvements are strictly localized to retrained portions of the visual field, which is a measure of the effectiveness and specificity of the therapy for inducing recovery. Another question that has not been addressed for the NovaVision VRT is whether the recovery induced generalizes to visual functions other than detecting spots of light. Finally, some recent published data (Reinhard et al., (2005) *Br. J. Ophthalmol.* 89:30-35, incorporated herein by reference) questions whether the NovaVision-elicited improvements in visual field size are actually real if one controls the patients' fixation very precisely.

Moreover, the training system used in the NovaVision VRT is prone to the development of compensatory strategies or "cheating" by the subjects, which can take two forms. (1) Subjects learn to use light scatter information from the white spot of light that is presented at the border between good and bad portions of the visual field. (2) Because eye movements are not tightly controlled during the training or testing phases, patients learn to make micro-saccades (or tiny eye movements) towards their blind field, which allow them to see the spots of light and thus, perform better on the test.

Some embodiments disclosed herein provide systems and methods for retraining and evaluation of patients (human or animal, adult or developing) with damage to the visual system, cortical and/or sub-cortical. In some embodiments, the concepts and methods described herein are also applicable to retraining patients with damage of other sensory system, for example, somato-sensory, auditory, olfactory, gustatory, proprioception, and the like.

Some embodiments of the present invention address some of the drawbacks of existing retraining systems discussed above. For example, some embodiments include use complex, dynamic visual stimuli, for example, random dot kinematograms, that are spatially extended. To date, only simple, non-spatially extended (e.g., single dots), static visual stimuli have been used to retrain patients (e.g., the NovaVision VRT). In contrast, the disclosed retraining system aims to retrain complex motion perception in humans. In addition, some embodiments request the patient to make a discrimination rather than detection judgment.

Furthermore, some embodiments include a retraining system that differs both from previously published animal data (see, for example, Huxlin K. R. and Pasternak T. (2004) "Training-induced recovery of visual motion perception after extrastriate cortical damage in the adult cat." *Cerebral Cortex* 14: 81-90, incorporated herein by reference) and from published human data (see NovaVision reports) in that it uses a low-contrast visual stimulus, for example, grey dots on a bright background, to ensure that substantially only impaired portions of the visual field are being stimulated. These embodiments reduce the likelihood that patients will learn to interpret light scatter, for example, from a bright visual stimulus presented on a dark background that may give a false positive result (i.e., improvement in visual performance) rather than a real recovery of vision in impaired portions of the patient's visual field. In some embodiments, the system is designed to specifically stimulate and increase function in higher-level visual cortical areas, which are often spared following strokes that destroy primary visual cortex. Our strategy is to sufficiently increase function in these higher-level areas, visual field location-by-visual field location using a seeding approach until a significant restoration of function and a significant increase in the size of the visible field has been attained, particularly in patients with severe deficits and minimal sparing of vision.

In some embodiments, visual retraining is paired with a means of evaluating the improvements in complex visual perception in complex, three-dimensional naturalistic, environments, both real and virtual. Such environments are not currently in use clinically, where the mainstay of visual testing is a static measurement of perception throughout the visual field using either Goldman or Humphrey perimetry. Perimetry uses artificial-looking stimuli, is relatively insensitive, and does not measure complex visual perception or the use of visual information in complex, real-life situations. After all, what patients with visual loss are interested in is improvement in their use of visual information, not just a better score on an artificial, clinical test. Thus, embodiments of the invention use virtual reality and/or measured head and eye movements in the real world as an index of the patient's usage of visual information in complex, naturalistic situations as a means of assessing the effectiveness of a treatment plan in that patient.

Some embodiments provide a method for retraining the visual cortex of a subject in need thereof comprising: automatically displaying a visual stimulus within a first location of an impaired visual field of the subject; and detecting the subject's perception of a global direction of motion of the visual stimulus.

Some embodiments further comprise mapping at least one visual field prior to retraining. Some embodiments further comprise mapping a first impaired visual field and a second impaired visual field, wherein the first and second impaired visual fields are non-overlapping, and the first impaired visual field is retrained and the second impaired visual field is a control. In some embodiments, the mapping comprises perimetry. In some embodiments, the mapping comprises displaying a visual stimulus within an impaired visual field. In some embodiments, the impaired visual field is a blind field.

Some embodiments further comprise evaluating the progress of the retraining. In some embodiments, at least a portion of the evaluation is performed in a virtual reality environment. In some embodiments, at least a portion of the evaluation is performed in a real environment. In some embodiments, the retraining is performed at a border between the impaired visual field and a good visual field.

Some embodiments further comprise repeating the retraining on a second location of the impaired visual field, wherein the second location is not retrained. In some embodiments, the second location is selected automatically. In some embodiments, the second location was not retrainable prior to the retraining of the first location. In some embodiments, the center of the second location is not more than about 0.5° to about 1° visual angle from the center of the first location. In further embodiments, the center of the second location is not so restricted. For example, in some embodiments, the center of the second location is more than about 0.5° to about 1°.

In some embodiments, the visual stimulus is a random dot stimulus. In some embodiments, the dots have a brightness of not greater than about 50%. In some embodiments, the direction range of the dots is between about 0° and about 355°. In some embodiments, the percentage of dots moving coherently is from about 100% to about 0%. In further embodiments, the visual stimulus is substantially circular with visual angle diameter of at least about 4°.

In some embodiments, the visual angle diameter of the visual stimulus is from about 4° to about 12°. In some embodiments, the visual stimulus is displayed on a background, and wherein the background is grey.

In some embodiments, the background is brighter than the overall brightness of the visual stimulus. In some embodiments, background and the overall brightness of the visual stimulus is substantially similar.

Some embodiments further comprise adjusting the room lighting thereby reducing glare and effects of light scatter.

In some embodiments, auditory feedback is provided to indicate the correctness of the subject's response. In some embodiments, the retraining method comprises a two alternative, forced-choice task in which the subject is required to respond to the visual stimulus. In some embodiments, the subject's response is detected using a keyboard.

Some embodiments further comprise displaying a fixation spot on which the subject gazes during the display of the visual stimulus. In some embodiments, the subject's head is substantially fixed. In some embodiments, at least a portion of the retraining is performed outside of a laboratory or clinic.

Some embodiments further comprise performing from about 300 to about 500 retraining trials in a session. In some embodiments, retraining sessions are performed periodically. In some embodiments, retraining sessions are performed at least daily. In some embodiments, retraining sessions are performed over about from two to about three weeks.

In some embodiments, retraining sessions are performed until the subject reaches a desired endpoint. In some embodiments, the endpoint has a coefficient of variation of less than 10% of the mean threshold over a predetermined number of sessions, and the mean threshold is not significantly different from the threshold measured in at least one of the subject's intact visual field regions.

Further embodiments provide a system for retraining the visual cortex of a subject in need thereof, the system including a display configured for displaying a visual stimulus within a first location of an impaired visual field of a subject, a data processing unit, a data input device configured to detect the subject's perception of an attribute of the visual stimulus, and a storage medium on which is stored machine readable instructions, which are executable by the data processing unit to perform the disclosed retraining method. Some embodiments further comprise a head positioning device. Some embodiments further comprise an audio output device.

Yet further embodiments provide a system for retraining the visual cortex of a subject in need thereof, the system including a means for displaying a visual stimulus within a first location of an impaired visual field of a subject, a means for detecting the subject's perception of an attribute of the visual stimulus, a means for executing machine readable instructions, and a means for storing machine readable instructions, which are executable to perform the disclosed retraining method.

Some embodiments provide a computer-readable medium on which is stored computer instructions which, when executed, include an output module configured for automatically sending to a display a visual stimulus within a first location of an impaired visual field of the subject, and an input module configured for receiving the subject's perception of a global motion of the visual stimulus.

Further embodiments provide a method for mapping the visual field of a subject including displaying a visual stimulus within a first location of the visual field of the subject, detecting the subject's perception of a global direction of motion of the visual stimulus, and determining whether the first location of the visual field is impaired.

Some embodiments further include repeating the displaying of a visual stimulus within a first location of the visual field of the subject and detecting the subject's perception of an attribute of the visual stimulus. Some embodiments further include displaying a visual stimulus within a second location of the visual field of the subject, detecting the subject's perception of an attribute of the visual stimulus, and determining whether the second location of the visual field is impaired.

In some embodiments, the visual stimulus is substantially circular with visual angle diameter of at least about 4°. In some embodiments, the visual angle diameter of the visual stimulus is from about 4° to about 12°.

In some embodiments, at least one visual stimulus is a complex visual stimulus. In some embodiments, the complex visual stimulus is a random dot stimulus.

In some embodiments, the dots have a brightness of not greater than about 50%. In some embodiments, the direction range of the dots is between about 0° and about 355°. In some embodiments, the percentage of dots moving coherently is from about 100% to about 0%.

In some embodiments, at least one visual stimulus is a contrast modulated sine wave grating.

In some embodiments, the visual stimulus is displayed on a background, and the visual stimulus has a low contrast or substantially difference in brightness compared to the background. In some embodiments, the visual stimulus is displayed on a background that is brighter than the visual stimulus.

Some embodiments further comprise adjusting the room lighting thereby reducing glare and effects of light scatter.

In some embodiments, auditory feedback is provided to indicate the correctness of the subject's response. In some embodiments, the mapping method comprises a two alternative, forced-choice task in which the subject is required to respond to the visual stimulus. In some embodiments, the subject's response is detected using a keyboard. In some embodiments, at least a portion of the subject's response is detected using an eye-tracker.

Some embodiments further include displaying a fixation spot. In some embodiments, the subject's head is substantially fixed.

In some embodiments, at least a portion of the mapping is performed in virtual reality.

Further embodiments provide a system for mapping the visual field of a subject, the system including a display configured for displaying a visual stimulus within a first location of the visual field of a subject, a data input device configured to detect the subject's perception of a global direction of motion of the visual stimulus, a data processing unit configured to determine whether the first location of the visual field is impaired, and a storage medium on which is stored machine readable instructions, which are executable by the data processing unit to perform the disclosed mapping method.

Some embodiments further comprise a head positioning device. Some embodiments further comprise comprising an audio output device.

In some embodiments, the display includes a virtual reality display. In some embodiments, the data input device includes an eye-tracker.

Certain embodiments provide a computer-readable medium on which is stored computer instructions which, when executed, include an output module for displaying a visual stimulus within a first location of the visual field of the subject, an input module for detecting the subject's perception of a global direction of motion of the visual stimulus, and a data processing module for determining whether the first location of the visual field is impaired.

Some embodiments provide a system for mapping the visual field of a subject, the system include a means for displaying a visual stimulus within a first location of the visual field of a subject, a means for detecting the subject's perception of a global direction of the visual stimulus, a means for executing machine readable instructions and determining whether the first location of the visual field is impaired, and a means for storing machine readable instructions, which are executable to perform the disclosed mapping method.

Some embodiments provide a method for mapping the visual field of a subject including displaying a visual stimulus on a background within a first location of the visual field of the subject, wherein the visual stimulus is darker than its immediate background, detecting the subject's perception of the visual stimulus, and determining whether the first location of the visual field is impaired.

DETAILED DESCRIPTION

Figure 1:
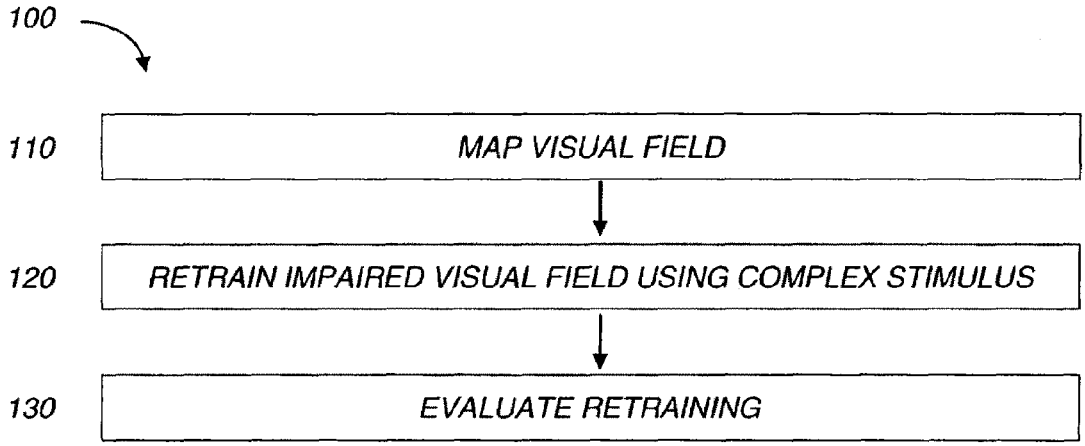
FIG. 1 is a flowchart illustrating embodiments of a method for visual retraining of a patient in need thereof.

The terms "subject" and "patient" both are used herein to refer to an individual undergoing using the retraining system and method disclosed herein. As used herein, the term "complex visual stimulus" refers to a visual stimulus that requires higher levels of the visual system to process the stimulus in order to perceive it. In contrast, a simple visual stimulus is one that is processed and perceived by the lower levels of the visual system, typically up to and including the primary visual cortex. For example, the random dot kinematograms discussed below are considered complex motion stimuli because a primary visual cortical neuron cannot process and signal the correct motion of the entire stimulus (global motion) because the neuron has a small receptive field, which sees only one or two of the dots in the random dot stimulus. Neurons with a large receptive fields, such as those found in higher level visual cortical areas, are able to see many dots at the same time and to integrate the individual dot directions to extract a directional vector for the entire stimulus. Luminance modulated, drifting sine wave grating stimuli, also discuss below, are simple stimuli because visual neurons with small receptive fields, such as are found in the visual system up to primary visual cortex, are able to detect and discriminate these stimuli, giving rise to an accurate percept of the whole stimulus's motion without actually seeing the whole stimulus. All references cited herein are incorporated by reference in their entireties.

Embodiments of the disclosed retraining system for inducing visual recovery requires subjects to practice visual discrimination of a complex visual stimulus within their blind field until normal discrimination thresholds have been reached. In the evaluation of the effectiveness of training, the visual discrimination thresholds reported by subjects are verified in a laboratory or clinic with strict eye movement controls. A patient's vision is considered recovered at a particular visual field location when normal sensitivity thresholds are attained and maintained, not simply after good percentage of correct performance on the task is attained. In some embodiments, testing the generalizability of improved discrimination thresholds is performed not only using clinical visual field tests (e.g., the Humphrey and Goldman visual field tests), but also either in virtual reality or in a real, natural environment through the use of a portable eye tracker and special computational algorithms for reconstructing head and eye movements, which evaluates a subject's ability to use visual information in naturalistic, three-dimensional conditions.

By requiring that subjects perform a discrimination rather than a simple detection task, the visual system is forced to perform image processing and to bring the resulting visual information to consciousness, something that does not occur when subjects are simply asked to detect stimuli without extracting any characterizing information about them. Discrimination tasks also reduce the ability of subjects to "cheat," relative to simple detection tasks.

Complex visual stimuli are believed to optimally activate higher-level visual cortical areas as well as lower level areas, and consequently, to activate significantly more brain areas than simple visual stimuli, for example, single dots. The complexity of the stimulus also reduces the ability of the subjects to "cheat." In addition, by using stimuli with reduced contrast, for example, grey on a white background rather than white on a black background, the ability of subjects to use light scatter information in order to do the task is eliminated.

In some embodiments, evaluation of training-induced improvements in discrimination thresholds is performed with tight control of eye movements. In some embodiments, a subject's gaze is monitored using an infrared pupil camera system (available, for example, from ISCAN, Inc., Burlington, Mass.) and this gaze is calibrated onto the fixation spot. If the gaze deviates from this spot outside a predefined window during stimulus presentation, the trial is aborted. Only trials in which the subject's gaze remains on the fixation spot are counted in the evaluation of the subjects' discrimination thresholds.

While it is good to show training-induced improvements in visual discrimination thresholds at the retrained visual field locations, the most important result for the subjects is for their functional vision to improve, that is, the way they use visual information to function in everyday life. Thus, in addition to performing the Humphrey and/or Goldman Visual Field tests that are standard in most ophthalmology clinics, the system disclosed herein measures how subjects use visual information in a complex, naturalistic, three-dimensional environment.

It should be pointed out that, in some embodiments, the tests used to assess a subject's performance differ significantly from the training system, which verifies that the subject's improvements are not simply due to becoming expert on the system used for retraining. An advantage of some embodiments of the disclosed system is that one can verify whether the visual training results not only in improved performance on the training task, but also translates into improved performance on other aspects of vision. In particular, measuring eye and head movements in three-dimensional environments, both virtual and real, provides an excellent approximation of the effects of training on a subject's usage of visual information in everyday life.

Some embodiments of the systems and methods disclosed herein, for example, the virtual reality and/or portable eye tracking systems, are useful in treating more diffuse brain disorders, for example, dementias (e.g., Alzheimer's disease and Parkinson's disease), and/or to assess and/or retard the negative sensory effects of aging. In further embodiments, the systems and methods are used by individuals without brain damage who are interested in improving or optimizing their visual performance for example, athletes and/or workers in high-performance jobs, for example, in the military and/or in aviation. Further embodiments provide a method for assessing usage of visual information in complex, naturalistic or natural, three-dimensional environments. As such, some embodiments measure "functional vision" rather than the artificially simple, 2-dimensional and static visual tests administered clinically or at the DMV, for example. Potential users of these embodiments include, for example, insurance companies that want to screen drivers for good, active vision in complex natural environments.

Certain embodiments include one or more of the following inventive features: preferentially stimulating higher order visual cortical areas in order to induce recovery of conscious and/or unconscious visual perception after damage to low-level and/or high-level areas of the visual system; using retrained portions of the visual field act as seeding areas for training-induced recovery at adjacent, previously blind areas where retraining was previously ineffective; and measuring visual performance in virtual reality and/or in real life as a means of safely and quantitatively assessing whether patients who show recovery of normal visual discrimination thresholds following visual retraining described below, actually use this recovered perceptual ability in everyday life situations.

FIG. 1 illustrates embodiments of a method 100 for retraining a subject with damage to the cortical and/or sub-cortical visual system. In optional step 110, motion perception in the visual field is mapped and blind fields identified. In step 120, the blind fields are retrained using a complex visual stimulus. In optional step 130, progress of the retraining is evaluated. In optional step 140, the retraining procedure is modified according to the results of the evaluation in step 130.

Figure 2:
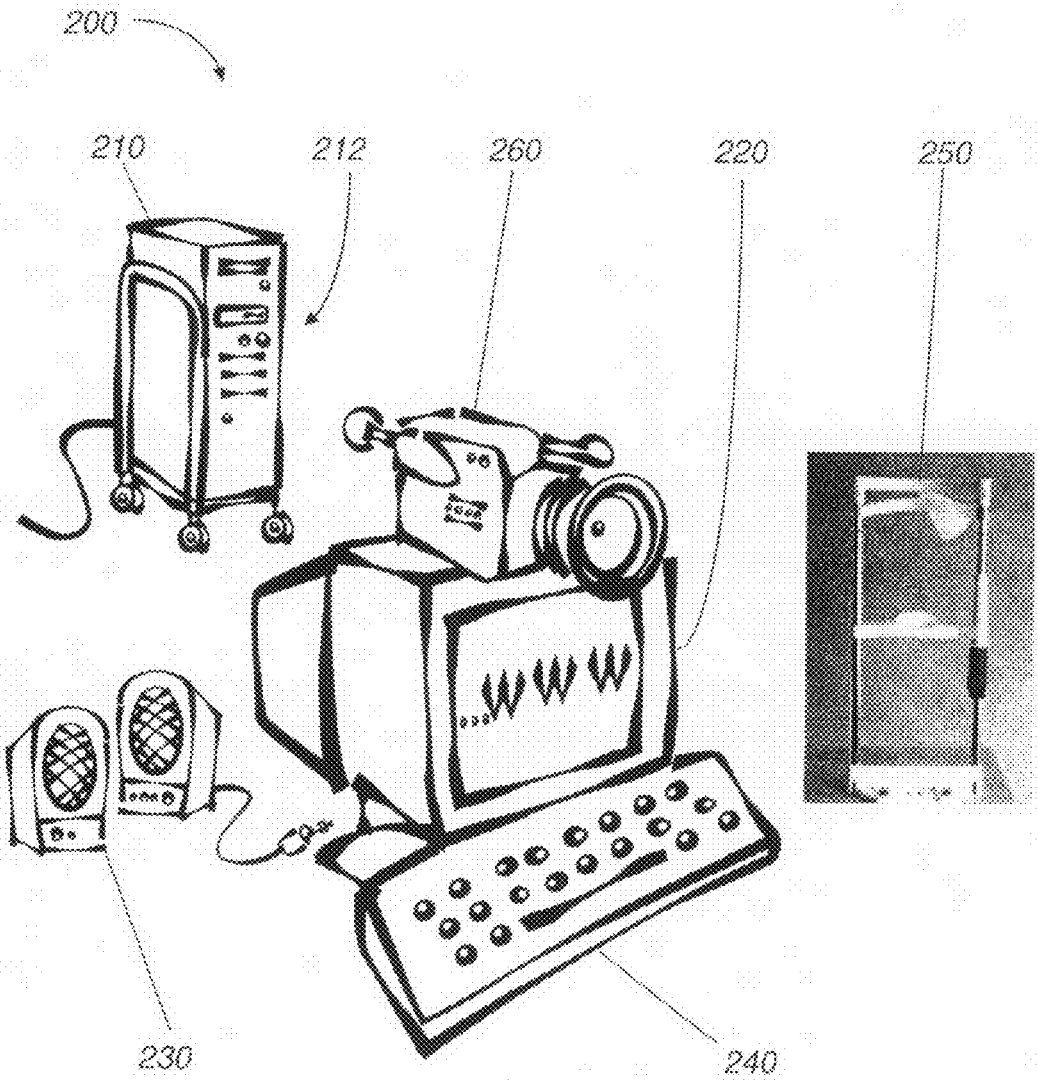
FIG. 2 schematically illustrates embodiments of a system for visual retraining.

In some embodiments, the method 100 is implemented in a retraining system. FIG. 2 illustrates an embodiment of a retraining system 200 comprising a data processing unit 210 comprising a storage medium 212 on which one or more computer programs in a format executable by the data processing unit 210 are stored implementing all or part of method 100. The data processing unit 210 also comprises a computer, microprocessor, or the like capable of executing the program(s).

The illustrated embodiment further comprises a display or monitor 220 operatively connected to the data processing unit, which is any type of display known in the art capable of displaying an image specified by the program(s), for example, a cathode ray tube (CRT) display, a liquid crystal display (LCD), a light emitting diode (LED) display, an organic light emitting diode (OLED) display, a plasma display, or the like. As discussed below, in some embodiments, the display 220 is a virtual reality display. In some embodiments, the retraining system 200 comprises an audio output device 230 used, for example, for providing instructions, audio feedback in the retraining process, and the like. Those skilled in the art will understand that other embodiments of the retraining system include other types of output devices, for example, a printer.

One or more input devices 240 is operatively connected to the data processing unit 210. The input device is any type known in the art, for example, a keyboard, keypad, tablet, microphone, camera, touch screen, game controller, or the like.

Some embodiments of the retraining system 200 further comprise a head positioning device 250. The head positioning device 250 is dimensioned and configured to maintain a desired relative position between a user's eyes and the display 220. Examples of suitable head positioning devices are known in the art, and include, for example, chin rests, chin-and-forehead rests, a head harness, and the like. In some embodiments, the head positioning device 250 is secured to and/or integrated with the display 220. In further embodiments the head positioning device 250 is independent of the display 220. An example of a suitable chin-and-forehead rest is the model 4677R Heavy Duty Chin Rest (Richmond Products Inc., Albuquerque, N. Mex.).

Some embodiments of the retraining system 200 further comprise a eye tracking device 260. Suitable eye tracking devices are known in the art, for example, video and/or infrared tracking systems. A commercially available system is available from ISCAN Inc. (Burlington, Mass.). In the illustrated embodiment, the eye tracking device is mounted on the top of the display 210. In some embodiments, the eye tracking device is operably connected to the data processing unit 210.

Some embodiments of the retraining system 200 include other features, for example, data recording devices, networking devices, and the like. In some embodiments, one or more components of the hardware are implemented on a personal computer (PC) system, for example, the data processing unit 210, storage medium 212, display 220, audio output device 230, and input device 240. In some embodiments the PC is a portable device, for example, a laptop computer. As discussed below, portability is advantageous in embodiments in which the retraining process is conducted outside of a clinical or laboratory setting, for example, in a user's home. In other embodiments, the retraining system 200 is not a portable device, for example, a desktop PC. In some embodiments, the data processing unit 210 comprises a plurality of microprocessors, and the processing tasks are distributed among at least some of the microprocessors. In some embodiments, the data processing unit 210 comprises a network comprising plurality of computers and/or microprocessors. In some embodiments, at least a portion of the data is stored and processed after the time when the data is collected.

In some embodiments, some or all of the hardware of the retraining system 200 is purpose-built. In further embodiments, the retraining system 200 is implemented on another type of hardware, for example, on a video game system, commercially available, for example, from Sony Electronics, Microsoft, Nintendo, and the like.

The retraining method 100 is described below with reference to the training system 200. Those skilled in the art will understand that the retraining method 100 is implemented on other hardware in other embodiments.

Step 110 mapping simple and complex motion perception in patients with visual field defects induced by brain damage.

Mapping is used to determine the location and extents of impairment in the visual field of a subject because of inter-subject variability in the effects to the cortical and/or sub-cortical damage to the brain.

Perimetry. In some embodiments, standard perimetry, for example, 10-2 and 24-2 Humphrey perimetry, Goldman perimetry, Tubingen perimetry, and/or high resolution perimetry, are conducted in each patient to map approximate locations of major losses in visual sensitivity. In some embodiments, patient test reliability is also established by tracking fixation losses, false positive rates, and false negative rates. A false positive occurs when a subjects reports seeing something when no stimulus is presented. A false negative occurs when a subject reports not seeing anything when, in fact, a stimulus was presented at a location where it was previously established that the subject can see normally.

Mapping Simple and Complex Motion. In some embodiments, the perimetry information is used to map simple and complex motion perception psychophysically across each patient's visual field, thereby ensuring that both intact and impaired visual field locations are evaluated in the mapping test. Currently, ophthalmologists do not measure simple or complex motion perception in patients suspected of having visual field losses. In this example, each patient is seated in front of the apparatus 200 comprising, for example, a 19" computer monitor 220 equipped with a chin rest and forehead bar 250, which are configured to stabilize the patient's head. The apparatus 200 also includes an eye tracker 260, which permits the precise tracking of the patient's eye movements over the course of the mapping test.

During the mapping test, room lighting is adjusted to minimize glare and the confounding effects of light scatter from presented visual stimuli. A fixation spot is displayed on the monitor 220 on which the patient is instructed to fixate precisely (e.g., within 1-2° visual angle around the fixation spot) for the duration of each test. Each patient performs approximately 100 trials of a two-alternative forced choice task using a complex visual stimulus. Examples of suitable visual stimuli include small, about 4° diameter, circular, random dot stimuli, which are useful, for example, for mapping perception of complex motion, and/or contrast modulated sine wave gratings, which are useful, for example, for mapping perception of simple motion. In some embodiments, the characteristics of complex visual stimuli are similar to those used in the retraining step 120, discussed in greater detail below. In some embodiments, the stimuli are used to test discrimination between left and right (horizontal) motion. Further embodiments use motion in other directions, for example, up and down motion (vertical axis), motion along one or more oblique axes, or combinations. In each trial, the patient records the perceived direction using a keyboard 240, for example, using the left and right arrow keys to indicate the perception of leftward and rightward motion, respectively. The audio output device 230 provides an automated auditory feedback as to the correctness of each response. In some embodiments, direction range, motion signal, and/or contrast thresholds for detecting and discriminating the left or right direction of motion are measured at several locations within both normal and blind portions of the visual field using standard psychophysical procedures. See, for example, Huxlin K. R. and Pasternak T. (2004) "Training-induced recovery of visual motion perception after extrastriate cortical damage in the adult cat," *Cerebral Cortex* 14: 81-90, the entirety of which is hereby incorporated by reference.

In some embodiments, the testing comprises a forced choice detection task, in which the patient is required to provide a response to each visual stimulus presented. Forced choice tasks are discussed in greater detail below.

In some embodiments, particular attention is paid to accurately mapping detection and discrimination performance at the border between the intact and blind hemi-fields. In some embodiments, patients' awareness of the stimuli are also tested at blind field locations, both by verbal report and by using a non-forced choice version of the detection task in which the patients are asked to press a button on the keyboard 240 if and when they become aware of the presence of the stimulus.

Step 120. retraining complex motion perception in patients with visual field defects induced by brain damage Selecting Visual Field Locations For Retraining. In some embodiments, several, non-verlapping, blind field locations are identified that border with an intact visual field in which patients are able to detect the presence of a stimulus but are unable to discriminate its direction of motion. At least one of these locations is selected for visual retraining, while at least another location is not retrained and is used as internal control for the passive effects of the retraining experience.

Visual retraining. In some embodiments, patients self-administer visual retraining, for example, in their own homes. The visual field location selected for retraining and the selected retraining program is programmed into embodiments of the retraining system 200 for home use, which in some embodiments, comprises a computer, microprocessor, and/or data processing device 210. During an initial evaluation, the patients are instructed in the use of the psychophysical training system 200 and sent home with the system.

In some embodiments, the retraining system 200 comprises any means known in the art for monitoring the patient's eye fixation 260, for example, an eye camera mounted to the top of the display 220 of the retraining system. Such embodiments are useful, for example, for patients that are poor fixators. The retraining system 200 is configured to monitor the patient's fixation. In some embodiments, when the system 200 detects poor fixation, the user is instructed that inaccurate fixation will invalidate the results; prevent, delay, or reduce any recovery of vision; and/or waste time and/or resources. In order to practice fixation, patients are allowed to practice accurate fixation in a laboratory setting using an eye-tracking system 260 that provides user feedback. In some embodiments, the system 200 aborts any trials in which the subject breaks fixation from the fixation target during stimulus presentation and/or data from such trials are excluded from the analysis.

Some embodiments of the retraining system 200 further comprise any positioning device 250 known in the art to correctly position the patient's eyes relative to the display 220. For example, in some embodiments, the head positioning device 250 comprises a pair of spectacle frames secured to the display 220, for example, a computer monitor, at a predetermined distance, for example, using string of a precise length. In other embodiments, the head positioning device 250 comprises a chin rest with or without a forehead bar. In some embodiments instructions are provided to the patient for installing the positioning device 250. In further embodiments, the positioning device 250 is configured, for example, during the initial evaluation session. In yet further embodiments, the retraining system 200 assists the patient in adjusting the positioning device 250, for example, using the eye tracking system 260 discussed above.

In some embodiments, the retraining system 200 is set up to present visual stimuli at predetermined visual field locations relative to the center of fixation. In some embodiments, patients are instructed to perform several hundred trials, for example, from about 100 to about 500, more preferably from about 200 to about 400 trials, of a direction discrimination, forced-choice task using a complex visual stimulus, for example, the random dot and/or grating stimuli described herein. In some embodiments, patients are instructed to perform this task once a day, every day of the week at a specified location in a portion of their blind field. Preferably, the task is performed in a darkened room illuminated by a source of dim, indirect lighting.

Figure 3:
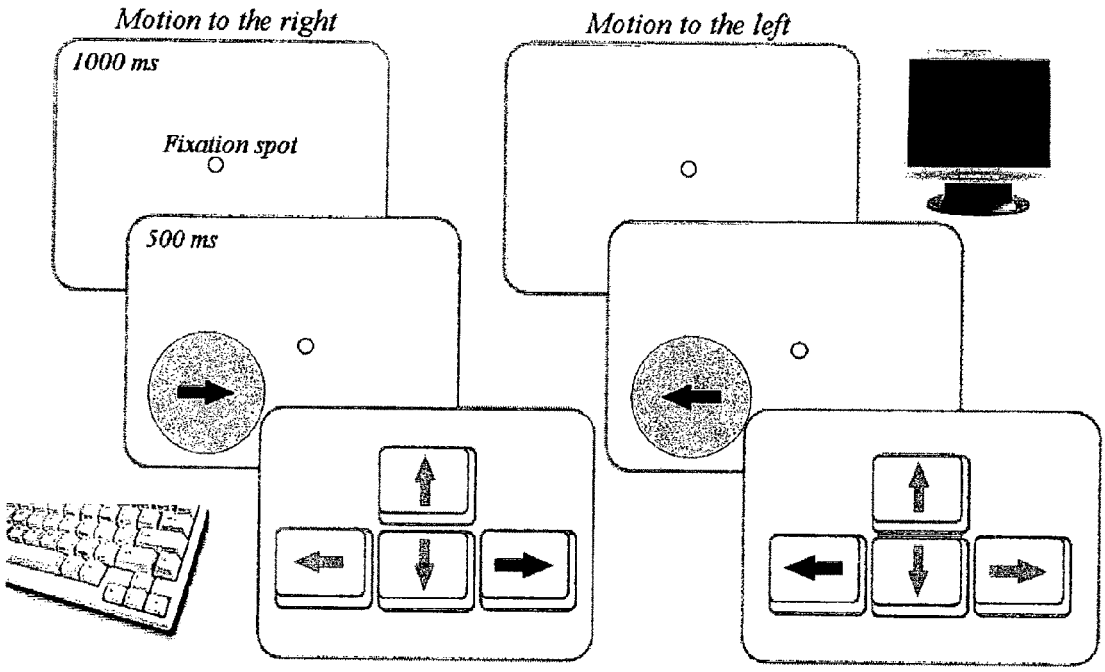
FIG. 3 schematically illustrates embodiments of a system for visual retraining FIG. 4A schematically illustrates embodiments of a random dot stimulus in which the direction range of the dots is 0° and the motion signal is 100%.

FIG. 3 schematically illustrates an embodiment of a two-alternative, forced choice, direction discrimination trial, useful, for example, in retraining, mapping and testing, and/or evaluation. In each of the schematic depictions of the display, the patient's blind field is illustrated in grey, and the normal field in white. Beginning in the top left of FIG. 3, after the patient fixates on the fixation point for 1000 ms, a visual stimulus is presented in the blind field for 500 ms, in this example, either moving to the right of moving to the left. The patient is forced to report the perceived motion, using the right and left arrow keys in this example.

Periodically, for example, once a week, patients send their data files for that period for analysis and fitting of performance thresholds. In some embodiments, the retraining system 200 automatically sends the data file. The periodic data updates are used to monitor the patient's progress and serve as a weekly check-up. In some embodiments, the training program is modified or customized based on these data.

In some embodiments, when patients exhibit recovery of thresholds to stable levels, for example, as defined by a coefficient of variation of less than 10% of the mean threshold over the last 10 sessions, at a particular visual field location, the program is modified to move the stimulus to an adjacent location situated deeper into the impaired visual field (bootstrapping). In preferred embodiments, the center of the new stimulus location is not more than from about 0.5° to about 1° visual angle from the center of the previous location. In some embodiments, the center of the new stimulus location is more than about 0.5° or about 1°. Bootstrapping is repeated until either the entire area of the deficit has been retrained or until the patient hits a "wall," that is, is unable to elicit any improvements in performance with this method. In some embodiments, retraining results are periodically, for example, about every 6-12 months, verified using a reference psychophysical system 200 equipped with eye-tracking capabilities 260, located, for example, at a clinic or at laboratory.

Figure 4:
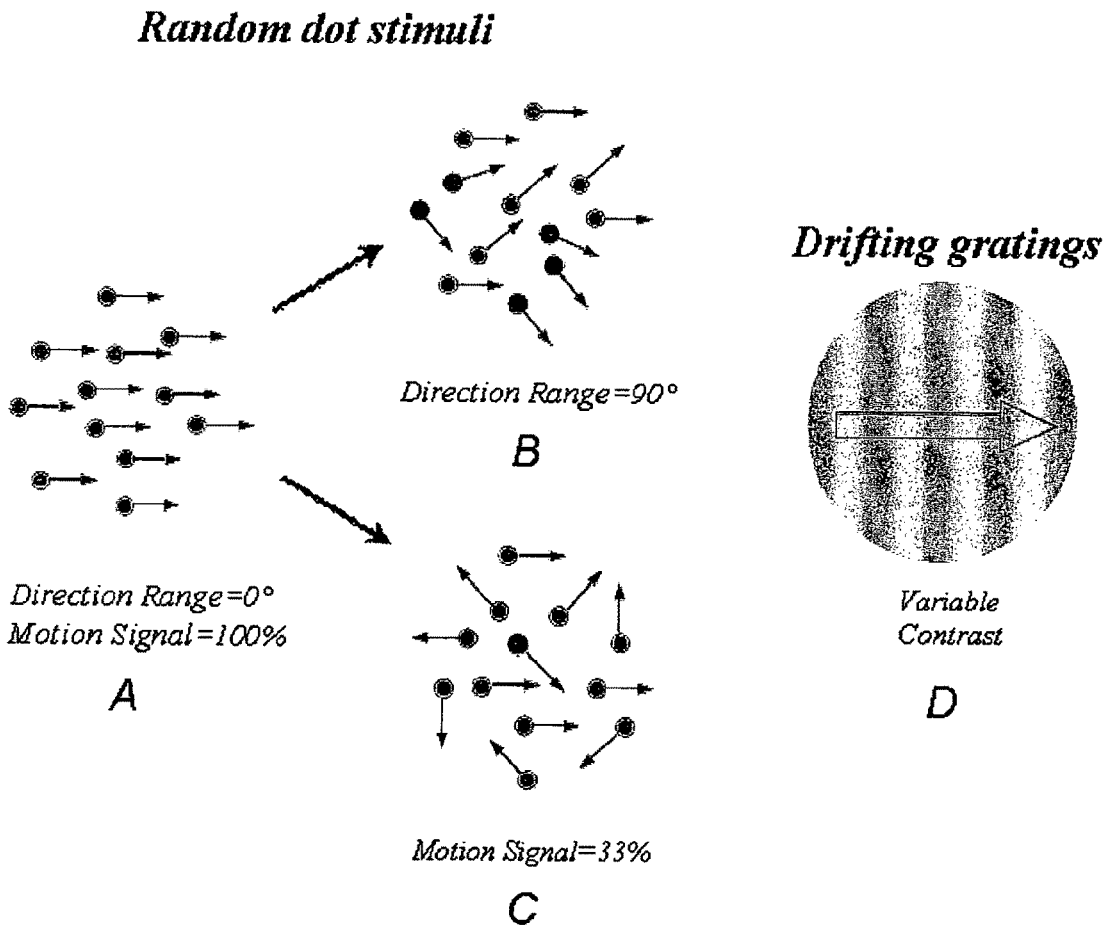
FIG. 4B schematically illustrates embodiments of a random dot stimulus in which the direction range of the dots is 90°.
FIG. 4C schematically illustrates embodiments of a random dot stimulus in which the motion signal is 33%.
FIG. 4D schematically illustrates embodiments of a sine wave grating stimulus in which the luminance contrast between the dark and light bars is varied during testing to measure contrast sensitivity.

Retraining stimuli. Some characteristics of the visual stimuli are discussed above in the context of the step 110. As discussed above, some embodiments of the disclosed retraining system use a complex visual stimulus. In some embodiments, the complex visual stimuli used in human patients differ significantly from those used previously in visual retraining work in cats. For example, the study reported in Huxlin K. R. and Pasternak T. (2004) used bright stimuli. As discussed below, bright stimuli generate light scatter that can spread to intact portions of a patient's visual field. Human patients, with their greater optical resolution relative to cats, learn to use the visual information from this light scatter to perform the task, resulting in a false impression of visual recovery. Some embodiments use a random dot kinematogram visual stimulus, for example, as disclosed in Rudolph K. and Pasternak T. (1999) "Transient and permanent deficits in motion perception after lesions of cortical areas MT and MST in the macaque monkey," *Cerebral Cortex* 9:90-100, incorporated herein by reference, in the mapping and/or training of complex motion perception. Some embodiments use at least one of the following stimuli:

1. Random dot stimuli in which the range of dot directions is varied in a staircase procedure from about 0° to about 355° in steps of about 40° are useful, for example, in retraining patients to discriminate different directions of global stimulus motion. In some embodiments, the steps sizes range, for example, from about 15° to about 75°, preferably, from about 20° to about 60°, more preferably from about 35° to about 55°. Other embodiments use other step sizes. Direction range thresholds as well as percentage correct performance is calculated for each training session by the software. "Direction range" refers to the range of directions in which random dots in a stimulus move. FIG. 4A schematically illustrates a random dot stimulus in which the direction range of the dots is 0°, while in FIG. 4B, the direction range is 90°.

2. Random dot stimuli in which the direction range is set to about 0° and the percentage of dots moving coherently is varied from about 100% to about 0% in a staircase procedure. In some embodiments the steps sizes range, for example, from about 15° to about 75°, preferably, from about 20° to about 60°, more preferably from about 35° to about 55°. Other embodiments use other step sizes. Motion signal thresholds as well as percentage correct performance is calculated for each training session. FIG. 4C schematically illustrates a random dot stimulus in which the motion signal is 33%, where the open dots moving to the right are the signal dots and the eight other dots are noise dots moving in random directions.

Some embodiments of the retraining system use a random dot visual stimulus comprising dots that are darker than their accompanying background. For example, in a certain embodiments, the retraining system uses grey dots (e.g., about 50% brightness or less) on a bright background (e.g., about 100% brightness) for the random dot stimuli. Those skilled in the art will also appreciate that this feature is also useful for contrast modulated sine wave grating stimuli discussed below. In contrast, the NovaVision VRT system and the cat study discussed above uses white dots (about 100% brightness) on a black background (about 0% brightness).

Although disclosed with reference to particular embodiments, embodiments of the retraining methods and systems described herein use a wide variety of brightnesses for the random dot stimuli displayed on the lighter background, thereby providing a visual stimulus with a reduced contrast compared to the background. For example, defining an 8-bit greyscale having values of 0-255, where 0 is associated with a pure black color and 255 is associated with a pure white color, some embodiments of the retraining system use a light background having a value of between about 150 and about 255 and grey dots having a value, or values, less than the value of the accompanying background, for example, within the range of from about 10 to about 245. In some embodiments, the retraining system uses a light background having a value of between about 230 and about 255 and grey dots having a value, or values, of between about 103 and about 153. In the forgoing description, characteristics of the visual stimuli are described as a grayscale with black and white as the endpoints thereof. Those skilled in the art will understand that in other embodiments, other endpoints are used, for example one or more colors. Those skilled in the art will also understand that these features are also applicable to the sine wave grating stimuli, described herein.

In some embodiments, there is little or substantially no net contrast in brightness between the visual stimulus and the background. For example, in some embodiments, each dot comprises light and dark pixels, and is presented on a grey background such that there is substantially no net contrast in brightness between the stimulus as a whole relative to the background. In other embodiments, the dots and background have substantially similar brightnesses, but have different colors.

Furthermore, in some embodiments, the visual stimuli are not limited to movement in the horizontal axis, which was the case in the cat study. In these embodiments, the patient's task is to indicate in which direction in which each stimulus moved by pressing a pre-determined key on a computer keyboard or other input device 240, for example, using the up and down arrow keys to indicate the perception of upward and downward motion, respectively. In some embodiments, a patient's performance at a range of different dot speeds is tested by varying the dots' $\Delta x$ (change in position) at a constant $\Delta t$, which in some embodiments depends on the refresh rate of the display, and is specific to each monitor or display. For example, in some embodiments, the dot speed is from about 2°/sec to about 50°/sec, preferably, about 10°/sec to about 20°/sec, more preferably, about 20°/sec. In some embodiments, the density of dots in the stimulus is adapted for each patient, for example, after the desired speed and/or direction of motion have been selected. In some embodiments, the dot density is about 0.05 dots/deg$^2$ to about 5 dots/deg$^2$, preferably, about 0.1 dots/deg$^2$ to about 3 dots/deg$^2$. In some embodiments, the size of the dots is adapted for each patient. Those skilled in the art will also understand that the minimum size of a dot is limited by the resolution of the particular display device. Those skilled in the art will also understand that the dot size and stimulus size set an upper limit on the dot density for a stimulus. In some embodiments, the dot size is from about 0.01° to about 0.05° in diameter, preferably, about 0.03°.

In some embodiments, the duration of a stimulus is from about 0.1 s to about 1 s, preferably, from about 0.2 s to about 0.8 s, more preferably from about 0.3 s to about 0.7 s. In some embodiments, the duration of the stimulus is 0.4 s, 0.5 s, or 0.6 s. In some embodiments, the lifetime of the dots in the stimulus is different from the duration of the stimulus, for example, from about 100 ms to about 500 ms, preferably from about 150 ms to about 350 ms, more preferably from about 200 ms to about 300 ms, for example, about 250 ms.

In some embodiments, patients also undergo testing and/or retraining for simple motion perception using sine wave gratings presented in a circular aperture whose size varies according to the size and geometry of each patient's field defect. In certain embodiments, each grating independently drifts in a predetermined direction and the patient's task is to indicate the perceived direction for each stimulus. Preferably, the spatial frequency for which the best contrast sensitivity is obtained in the blind field is then chosen and contrast thresholds are measured for a range of temporal frequencies. In some embodiments, the spatial frequencies range from about 0.5 cycle/deg to about 10 cycle/deg, preferably, from about 1 cycle/deg to about 5 cycle/deg, more preferably, about 2 cycle/deg. In some embodiments, the temporal frequencies range from about 0.5 Hz to about 30 Hz, preferably, from about 5 Hz to about 20 Hz, more preferably, about 10 Hz. In certain embodiments, stimulus duration for gratings follows either a 50 or 250 ms raised cosine temporal envelope to test whether the temporal onset and offset affect perception of this stimulus and the contrast thresholds attained.

In some embodiments the spatio-temporal frequency parameters of the sine wave gratings are chosen to elicit optimal performance during baseline testing. In some embodiments, the temporal Gaussian envelope is varied until the optimal slope is obtained. FIG. 4D schematically illustrates a circular, sine wave grating with a spatial frequency of 0.3 cycles/deg and a temporal frequency of 6 Hz.

In certain embodiments, training and/or mapping procedures are advantageously forced-choice and require patients to provide an answer for every stimulus presented, for example, the perceived global direction of motion of the stimulus. If patients do not know the answer, they are asked to guess. The training system provides auditory feedback for each answer to indicate whether or not it was correct. In some embodiments, patients are also asked to document their awareness of the stimuli and of their performance during the session, for example, using a survey and/or questionnaire. Daily training continues at each chosen visual field location until the patient's visual thresholds stabilize, for example, in about 100 sessions.

Those skilled in the art will understand that while the description herein focuses on retraining complex motion perception after strokes, the disclosed system and method are also applicable to retraining other visual modalities, such as orientation discrimination, shape discrimination, color discrimination, or letter/number/word identification, face discrimination, and/or depth perception. In each of these cases, the characteristics of the visual stimulus are selected to permit discrimination of the desired modality.

Step 130. post-training evaluation of visual performance

Psychophysical evaluation and verification of motion discrimination thresholds. As discussed above, in some embodiments, patients are periodically, for example, about every 6-12 months, brought back to the laboratory or clinic for verification of their improvement at retrained visual field locations. The laboratory or clinic is equipped with a retraining system 200, which is functionally identical to retraining system 200 sent home with the patients, except that the laboratory system is equipped with an infrared eye-tracking system 260, commercially available, for example, from ISCAN (Burlington, Mass.), which permits precise monitoring of a patient's fixation accuracy. In some embodiments, a patient's performance at control non-retrained locations in the intact and blind portions of the visual field are also evaluated. Verification of the patient's performance at the retrained location(s) is helpful to ensure that improvements in performance reported by the patient during training at home are not due to even involuntary saccades towards the visual stimulus (i.e., "cheating"). To date, we have had good success in reproducing at-home performance in the laboratory where an infrared system (ISCAN) is used to strictly monitor and control fixation. The clinical verification also permits assessment of the spatial spread of recovery beyond the boundaries of the retraining stimulus.

In some embodiments, the evaluation comprises a task similar to the testing and/or retraining tasks described above. In some embodiments, smaller, circular versions, for example, from about 1° to about 3°, of the retraining stimulus are used to measure performance within the boundaries of the retrained visual field area, thereby permitting determination of the proportion of the original stimulus being used by the patient to perform the task.

Evaluation of a patient's ability to use retrained visual motion perception to interpret visual motion information in real-life situations. In some embodiments, at least a portion of the evaluation is performed in a virtual reality environment and/or a real environment.

Rationale: Both simple and complex visual motion processing appear to play an important role in the accurate perception of the optic flow field generated by self-motion, as well as for the perception of moving objects in a complex, noisy, three-dimensional environment. Consequently, the performance of brain-damaged patients while walking or other task-performance in a three-dimensional environment is a natural domain for testing a patient's motion perception. The following describes a custom-designed virtual reality environment useful for measuring whether training-induced improvements in motion sensitivity generalize to locating moving objects in space, control of walking speed, heading and obstacle avoidance during walking. The disclosed test is also useful for pre-retraining mapping, testing, and evaluation.

Virtual reality apparatus, tasks & analysis. In the embodiment illustrated in FIG.5A, the virtual environment was created by presenting the patient with stereo images rendered on a Virtual Research V8 (Aptos, Calif.) head mounted display. The head is tracked by a HiBall-3000™ Wide-Area, High-Precision Tracker (Chapel Hill, N.C.) and the scene is updated after head movements with a 30-50 ms latency. This analog/optical system can track the linear and angular motion (6 degrees of freedom) of a receiver at very high spatial and temporal resolution over a large field, making it advantageous for evaluating usage of visual motion information in a dynamic environment. Dimensions of the virtual world were geometrically matched to the real world so that there is no substantial visuo-motor conflict generated by movement through the scene, except for the stereo-conflict between accommodation and vergence inherent in head-mounted displays. In the illustrated embodiment, an ASL 501 (Applied Science Laboratories, Bedford, Mass.) eye-tracker was mounted in the helmet, allowing eye and head position to be recorded in the data stream at 60 Hz. Those skilled in the art will understand that any suitable virtual reality display, head tracker, and/or eye-tracker known in the art also useful in this application.

Patients are required to detect and track individual basketballs that appeared at random locations throughout their visual field. The balls drift at a set speed, for example, about 20°/sec, towards the patients' head, disappearing just before impact. Other embodiments use other speeds and/or changing speeds. Patients are asked to track the basketballs with their eyes as soon as they detect them.

In addition, a video record is made, with eye position and an image of the eye superimposed (see, e.g., FIG. 6 below). Track losses are revealed in the eye image by loss of the crosshairs, but movement of the eye during track loss can still be measured using the eye image. Virtual objects are added to the scene, for example, in the form of flying basketballs, stationary obstacles, or pedestrians.

Figure 6:
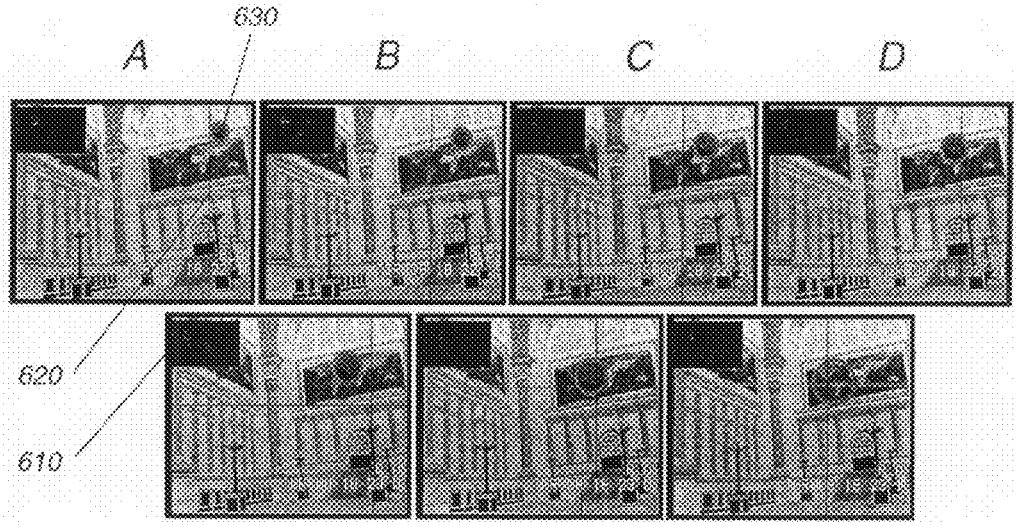
FIG. 6 are video frames taken from a patient's performance of a virtual reality task prior to retraining.

FIG. 6 provides video clips of a patient's performance of the basketball task in the sitting and freely fixating condition prior to retraining. The upper left window 610 in each frame shows the patient's eye, as viewed by the eye tracker camera. The cross-hairs 620 in the main frame indicate his gaze at each time point, which is identified by the "TCR" value in each frame. In the frame A, a basketball 630 appears in the patient's near upper right quadrant, which is a blind quadrant for this patient. He is unable to detect the basketball until it crosses into his good (left) field in frame D, at which point he saccades to it within a few frames (frame F), and tracks it until it disappears (frame G). As indicated by the crosshairs 620, in this example, the subject, who is blind in the right hemifield, does not detect or look at the basketball 630 until it crosses into his intact left hemifield, at which point he moves his eyes to it. Note that the heavy outlining of the basketball 630 in these frames is provided to highlight the basketball 630 for the reader. The basketball 630 is typically not highlighted during testing.

Figure 5:
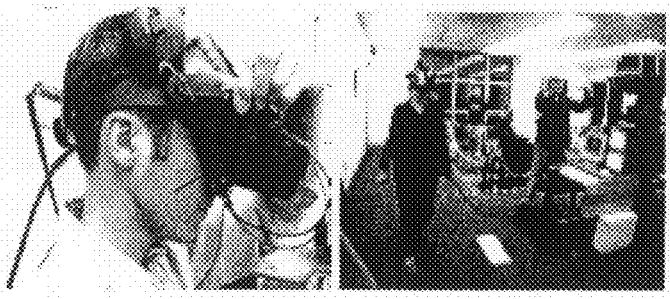
FIG. 5A is a photograph of embodiments of a virtual reality helmet comprising an in-built virtual reality display and eye tracker.
FIG. 5B is a photograph of a subject using the virtual reality helmet illustrated in FIG. 5A while performing a task in a virtual reality environment.

To specify the path over which the subjects walk, markers are positioned at the corners of a rectangular region in the virtual environment, corresponding to the corners of the path (80 ft total length in the illustrated embodiment) in the actual experimental room. Subjects are asked to walk around this rectangular region five times in both directions (so that in half the trials, they will turn into the blind hemifield) in each of four tasks: (1) walking with no obstacles, (2) walking with stationary obstacles, (3) walking with pedestrians, and (4) walking with flying basketballs. Tasks 2, 3, and 4 all produce complex motion patterns on the retina, with the greatest retinal translation generated by flying basketballs. If gaze is fixed in the direction of heading, obstacles will loom in tasks 2 and 3, but their centers will not translate on the retina. Thus they are defined as a singularity in the flow field. The patients start with several practice trials in different parts of the environment to familiarize themselves with walking in the virtual environment. Subjects instructions were: task 1, simply walk the path; tasks 2 and 3, walk the path and avoid the stationary obstacles and pedestrians; task 4, walk the path and track the flying basketballs with your eyes as soon as you detect them. Some of the stationary obstacles and some of the pedestrians are close enough to the path that subjects need to deviate from a straight line in order to avoid them. They are distributed in both visual hemi-fields. Patients perform all tasks either while keeping their gaze and head position directed straight ahead, or while freely fixating in the environment. FIG. 5B is a photograph of a subject performing a task in virtual reality.

In certain embodiments, eye and head position signals are recorded during the tests for each subject, along with walking speed and heading accuracy relative to the pre-determined path. Fixations are identified using in-house software and verified by analysis of the video record. The location of the fixations is identified from the video replay. In addition to the video record from the observer's viewpoint, software is used to replay the trial from an arbitrary viewpoint, with gaze indicated by a vector emanating from an ellipsoid indicating the subject's head position. This allows easy visualization of the relationship between gaze and body/head motion. The time at which objects and obstacles are fixated after they come into the field of view is recorded, and the retinal location of each obstacle 200-300 ms prior to a saccade to the obstacle is identified. In conditions when gaze is free, gaze strategies are evaluated. The visual field is divided up into regions (e.g., Shinoda H. et al. (2001) "Attention in natural environments" *Vision Research* 41:3535-3546; Turano K. A. et al. (2002) "Fixation behavior while walking: persons with central visual field loss" *Vision Research* 42:2635-2644; both of which are incorporated herein by reference), and frequency of fixations in these regions measured. The probability of fixating a particular region, given the current fixation region is also measured. This description of gaze patterns in terms of transition probability matrices is also useful in other natural tasks because it captures the loose sequential regularities typical of natural scanning patterns and appears to be sensitive to a variety of task and learning effects.

Figure 7:
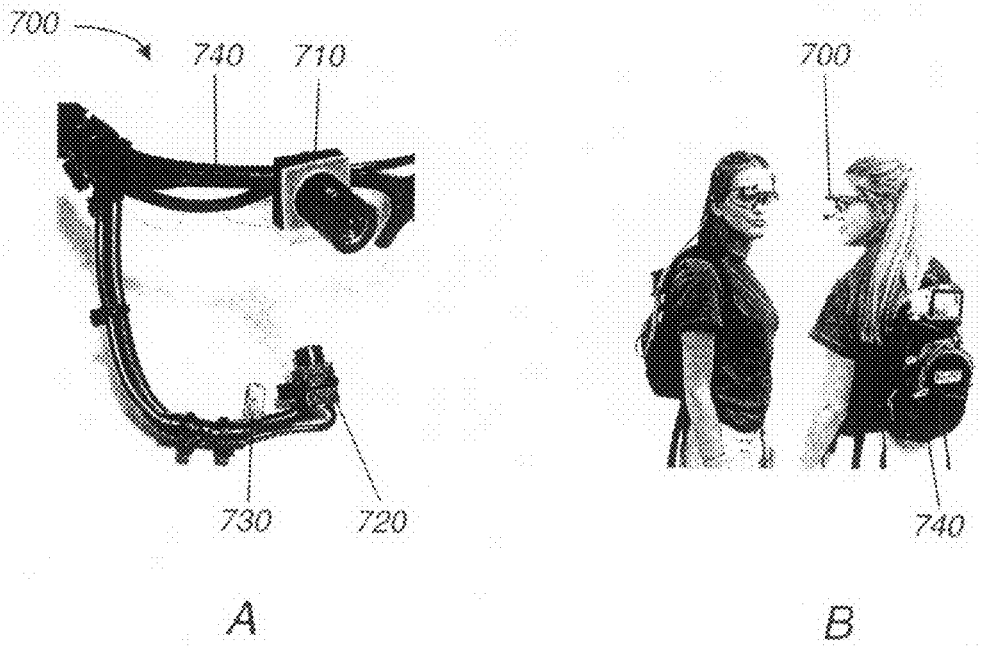
FIG. 7A and FIG. 7B are photographs of embodiments of a cordless, wearable eye-tracker useful for measuring head, eye, and/or body movements in a real environment.

Apparatus, Tasks, and Analysis for Real Environment. In some embodiments, the evaluation is performed in a real environment, either in addition to or instead of the virtual reality evaluation discussed above. In some embodiments, the subject wears a wearable eye tracker, which allows the monitoring of the wearer's gaze during the evaluation. FIG. 7A illustrates an embodiment of a wearable eye tracker 700 developed at RIT by Dr. Jeff Pelz, and reported in Pelz J. B. and Canosa R. (2001) "Oculomotor behavior and perceptual strategies in complex tasks." *Vision Research* 41:3587-3596, incorporated herein by reference. The illustrated eye tracker 700 comprises a scene camera 710, an eye camera 720, and an infrared LED 730. In the illustrated embodiment, these components are mounted to an eyeglass frame 740. The scene camera 710 provides an image of what the wearer is facing. The infrared LED 730 illuminates the wearer's eye for imaging by the eye camera 720, thereby permitting the monitoring of the wearer's gaze while performing an evaluation task in a real environment. In the illustrated embodiment, the supporting electronic components for the eye tracker 700 are mounted in a backpack 740, as shown in FIG. 7B. The RIT wearable eye-tracker offers a number of important advantages over commercially available eye-tracking systems: (i) the headgear worn by the observer is lightweight and comfortable, (ii) mounting the scene camera just above the tracked eye virtually eliminates horizontal parallax errors and minimizes vertical parallax, and (iii) image processing to extract gaze position is performed offline, so that the observer wears a lightweight backpack containing only a battery, video multiplexer and a camcorder to display the images and record the multiplexed video stream. Offline processing is particularly useful for individuals who are difficult to calibrate, as calibration can be completed without requiring the observer to hold fixation for extended periods.

In some embodiments, head-in-space position is measured either using a HiBall-3000™ Wide-Area, High-Precision Tracker for walking within the experimental room, or by a system of curved mirrors mounted on the head for measurements over a wider range of natural settings, for example, as disclosed in Babcock J. S. et al. (2002) "How people look a pictures before, during and after scene capture: Bushbell revisited." in Pappas R., Ed. *Human Vision and Electronic Imaging VIII pp.* 34-47; and Rothkopf C. A. and Pelz J. B. (2004) "Head movement estimation for wearable eye tracker" *Proceedings of the ACM SIGCHI Eye Tracking Research & Applications Symposium, San Antonio*; each of which is incorporated herein by reference. Image processing algorithms developed by Rothkopf and Pelz (2004) are then used to recover head position history. In the same experiment room where the virtual reality testing is carried out, subjects are asked to walk 5 times around the same path (marked on floor) that was used in the virtual environment (task 1) in order to compare the subjects' visual behavior in the real and virtual environments.

As in the virtual reality tasks, subjects are tested under different conditions, for example: (i) with gaze and head position fixed, looking straight ahead and (ii) with no restraints on gaze or head position. Subjects were also asked to walk down an unfamiliar corridor, locate the bathroom, and wash their hands. Another task is to find the stairwell and walk down a flight of stairs. Eye and head position signals are recorded for each subject, along with walking speed and heading accuracy relative to the pre-determined path, for experiment room tasks, or shortest path to the target, in real environment tasks involving locomotion in unfamiliar corridors and stairs. We also measure gaze patterns both in terms of the number of fixations, location of gaze and transition probabilities.

Measuring gaze distributions in virtual reality and in reality to determine if visual retraining improved usage of visual motion information in complex 3-dimensional real and virtual environments. Following training, subjects undergo a repeat of the baseline virtual reality and real reality tests described in Step 1. Gaze distribution, speed and accuracy, as well as detection accuracy of moving targets, ability to avoid obstacles are compared with similar measures collected before the onset of training.

Perimetric evaluation of changes in the size of the blind field. Standard perimetry (e.g., 10-2 and 24-2 Humphrey perimetry, as well as Goldman perimetry) is repeated and compared with the same tests performed prior to the onset of retraining to determine to what extent the retraining affected the extent of impaired visual field regions. Patient test reliability is also remeasured by tracking fixation losses, false positive and false negative rates, in order to ensure that improvements in visual field tests were not due to cheating, whether intentional or not.

Particular embodiments of the disclosed methods and systems are described in detail in the following Examples. Those skilled in the art will understand that this Example is illustrative only and is not intended to limit the scope of the disclosure.

Example 1

Two adult humans, one male and one female, both 51 years of age, were recruited about one year after their strokes. Both suffered damage affecting V1 and extrastriate visual cortical areas, as determined from MRI scans of their heads.

Figure 8:
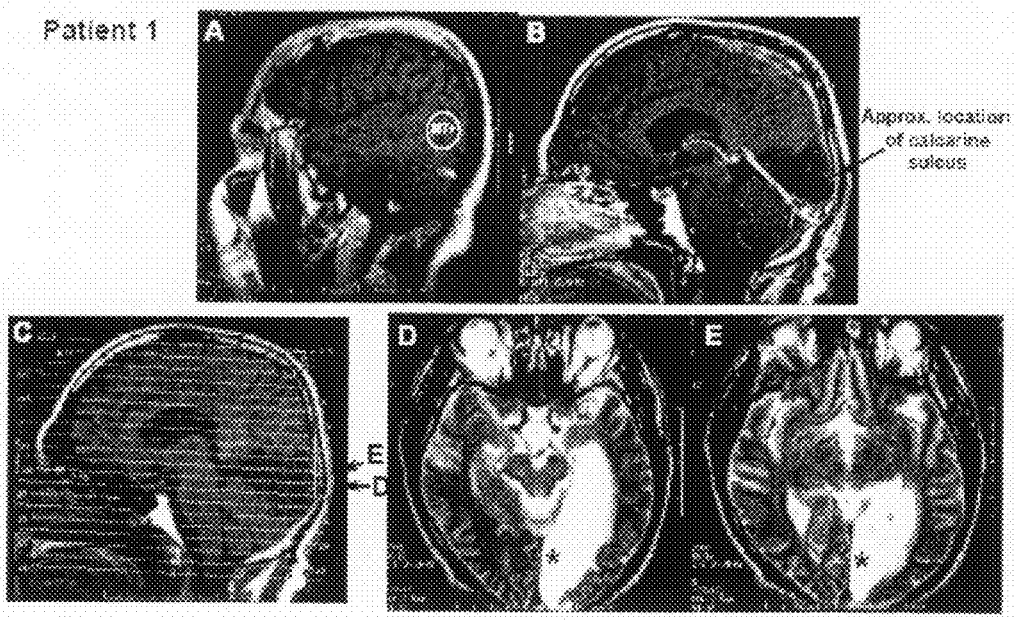
FIG. 8A-FIG. 8E are MRI scans of Patient 1's cortical lesion.

FIG. 8A-FIG. 8E are MRI scans of Patient 1's cortical lesion. FIG. 8A is a T1 weighted scan of the left cerebral hemisphere showing an intact MT complex. FIG. 8B is a T1 scan showing the occipital damage (dark cortex) affecting V1 on both banks of the calcarine sulcus, as well as extrastriate areas ventrally. FIG. 8C is a reference image, showing planes where sections illustrated in FIG. 8D and FIG. 8E were collected. FIG. 8D and FIG. 8E are T2 weighted sections showing extensive damage (*) to cortex and white matter in the banks of the calcarine sulcus, as well as in the medial and infero-temporal lobe of the left hemisphere.

FIG. 9A-FIG. 9G are T1-weighted MRI scans of Patient 2's multiple brain lesions. FIG. 9A is a horizontal scans showing the location of abnormal grey and white matter in the putative V1 of this patient. FIG. 9B and FIG. 9C are coronal scans showing the V1 lesion in FIG. 9B and some of the extrastriate, parietal damage in FIG. 9C. FIG. 9D-FIG. 9G are parasaggital sections showing an intact area of cortex where the putative MT complex lies (FIG. 9D), as well as different views of the multiple cortical lesions in this patient. Note that the V1 lesion (arrows) is centered on the calcarine sulcus and is much smaller than that in patient 1.

Both had documented, homonymous visual field losses. Patient 1 exhibited an almost complete right hemianopia, while Patient 2 exhibited a small, right lower quadrant defect. In both cases, the human MT/MST complex appeared to be intact (circled in FIGS. 8A and 9D), which is relevant to our goal of retraining complex visual motion perception using stimuli and tasks that have been demonstrated to rely critically on an intact MT complex (or equivalent) in monkeys.

Figure 10:
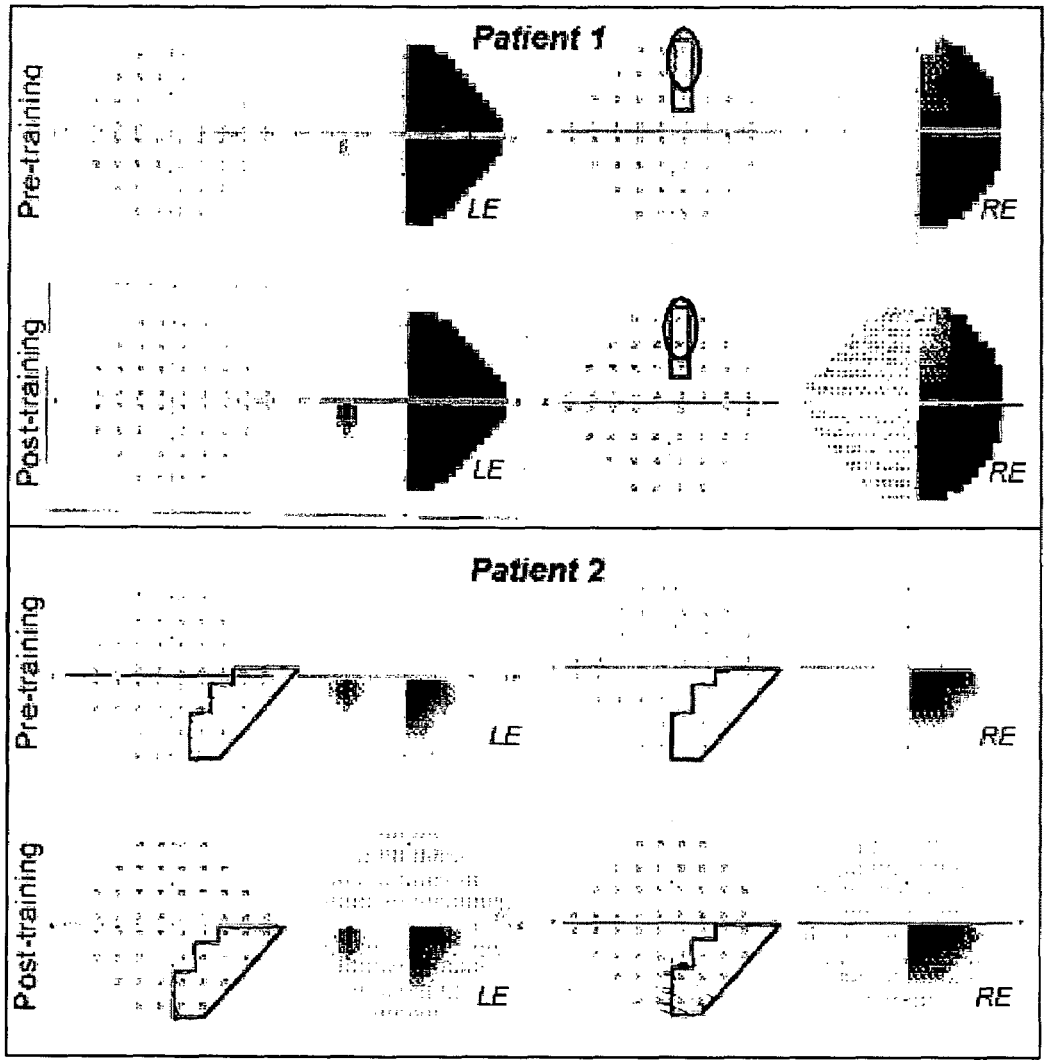
FIG. 10 provides Humphrey visual field results for Patients 1 and 2 before and after retraining.
Figure 11:
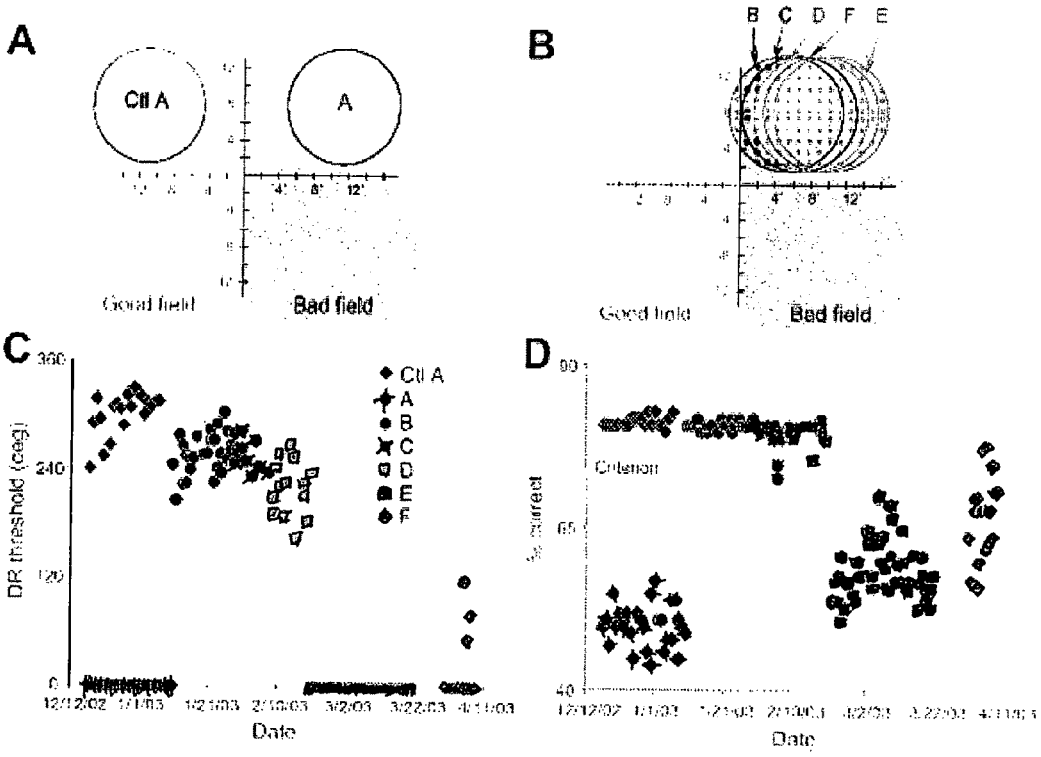
FIG. 11A-FIG. 11D provide retraining complex motion results in Patient 1.

Baseline testing was conducted, which included both Humphrey and Goldman visual field tests to verify the previously reported visual field defects and to ascertain that these had not changed significantly from those measured immediately after the stroke. Humphrey fields are shown in FIG. 10 for both patients before retraining. Psychophysical mapping of motion sensitivity was then performed at several locations throughout the patients' visual fields using random dot stimuli and contrast-modulated gratings. Patient 1 was first tested and trained at location A in high right upper visual field quadrant, as discussed below and illustrated in FIG. 11.

Patient 1's visual field defect is shown as grey areas in FIGS. 10A and 10B as determined by Humphrey perimetry, with circles representing the locations and sizes of random dot stimuli used to measure direction range thresholds for left-right direction discrimination. FIGS. 10C and 10D are graphs of direction range (DR) thresholds and % correct performance for each testing session versus date of testing (1-2 sessions of 300 trials were performed each day at the designated visual field locations).

Patient 1 performed 8400 trials (over 28 sessions) of a left-right direction discrimination task at location A (FIG. 11A) using random dot stimuli whose size and exact position are shown in FIG. 11A. In spite of the large stimulus size chosen, at location A, patient 1 never improved beyond chance performance (50% correct) and never obtained direction range thresholds above 0°, which require at least 75% correct performance (+in FIGS. 11C and 11D). This was in spite of the fact that the stimulus partially overlaid a relative sparing of visual detection performance, as measured by the Humphrey visual field test and indicated by light grey shading in FIG. 11A. Performance at the equivalent visual field location in his good field (Ctl A, FIG. 11A) was normal: 81.5+0.8% correct, direction range threshold=302°+24° (mean+SD; ♦ in FIGS. 11C and 11D). Therefore, it seems that placing a retraining stimulus just anywhere in the blind field was not conducive to attaining improvements in visual performance in this patient.

The next strategy, shown in FIG. 11B involved moving the stimulus to the border between the blind and intact hemifields (location B in FIG. 11B). Although only about 1.5° of the stimulus, which was 12° in diameter, overlapped his good field, Patient 1's performance at location B was relatively normal (● in FIGS. 11C and 11D), suggesting that he needed to see only a small portion of the stimulus in order to do the task. After 28 sessions, the stimulus was moved to location C (FIG. 11B) where although it was now completely contained within the blind field, performance was, to our surprise, relatively normal (x in FIGS. 11C and 11D). After 15 sessions at this location, the stimulus was again moved further into the blind field, to location D. Threshold performance dropped, but the patient reported seeing part of the stimulus and was able to maintain direction range thresholds of 221°+31° (▭ in FIGS. 11C and 11D). Moving the stimulus to locations E and F resulted in a dramatic drop to chance performance and 0° direction range thresholds. Since performance at location F (◇ in FIGS. 11C and 11D) was marginally better than that at location E (■ in FIGS. 11C and 11D), location F was chosen as the next site of intensive visual retraining for this patient.

Figure 12:
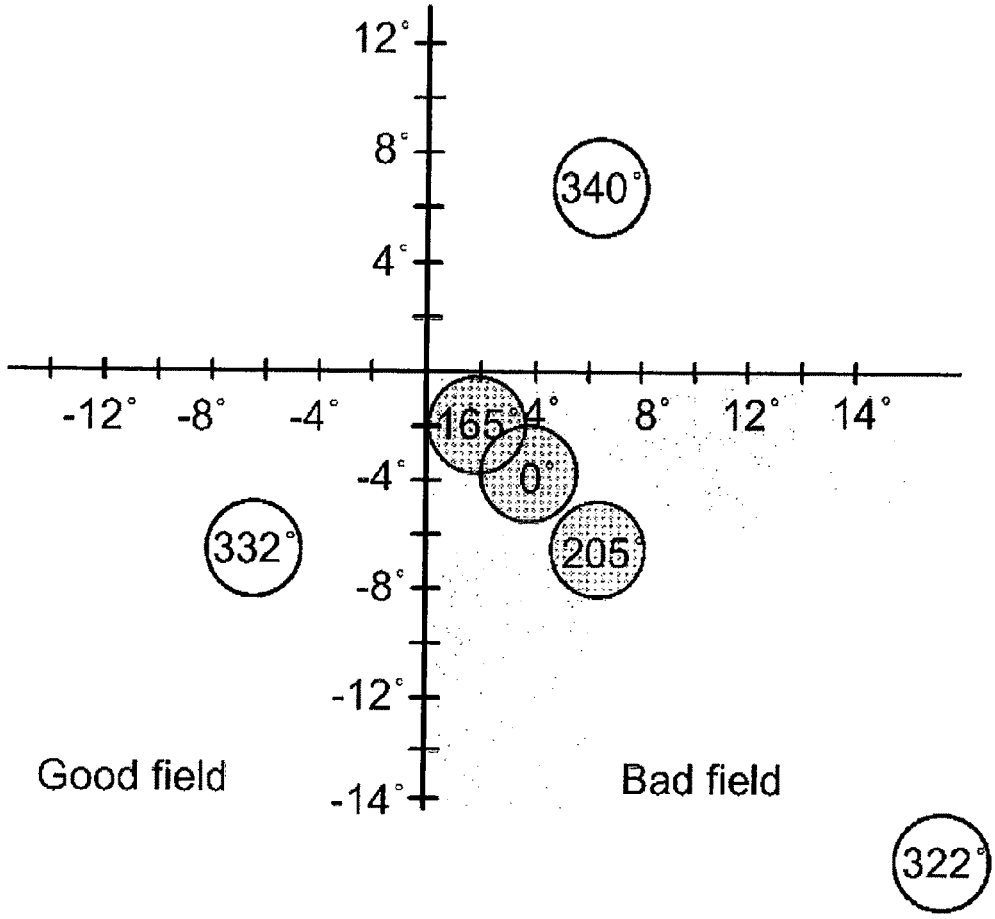
FIG. 12 provides visual field mapping results for Patient 2 using Humphrey perimetry and complex visual stimuli.

Patient 2 had a smaller visual field defect than Patient 1, with a blind area restricted to her near, lower right visual quadrant. FIG. 12 summarizes mapping of Patient 2's visual field by Humphrey visual fields and using complex visual stimuli. The predicted deficit in her visual field predicted from the Humphrey visual fields are shown in grey. Circles denote the size and location of random dot stimuli used to measure performance. The numbers inside the circles are direction range thresholds obtained at each location. As shown in FIG. 12, the original mapping of her blind field with random dot stimuli revealed a relative sparing of direction range thresholds (165° rather than 0°) at the location closest to the center of gaze. This was somewhat surprising given her Humphrey visual field result, which showed an absolute detection deficit along both vertical and horizontal meridians and right up to the center of gaze (FIG. 10). Deeper into her scotoma, testing with random dot stimuli did reveal a zone of deep deficit where direction range thresholds fell to 0°, flanked by another zone of relative sparing (direction range threshold=205°). Normal performance could be elicited at equivalent eccentricities in the three intact quadrants of her visual field, as well as at a large eccentricity within the lower right quadrant. For this patient, we decided to start retraining as close as possible to the center of gaze (FIGS. 12 and 13B) using a much smaller retraining stimulus than used for Patient 1, because of the smaller size of her visual field defect.

Once retraining locations were chosen, both patients performed 300 trials per day of a direction discrimination task using random dot stimuli drifting either to the right or the left, and in which the range of dot directions was varied using a staircase procedure. Dots moved at 10 deg/sec for Patient 1 and 20 deg/sec for Patient 2. These speeds were selected because they were optimally discriminated by the patients during initial testing. Dot density was 1.25/deg$^2$ for Patient 1 and 0.7/deg$^2$ for Patient 2, again chosen because they resulted in optimal performance by each patient. For each session, an overall percent correct and a direction range threshold were calculated.

Figure 13:
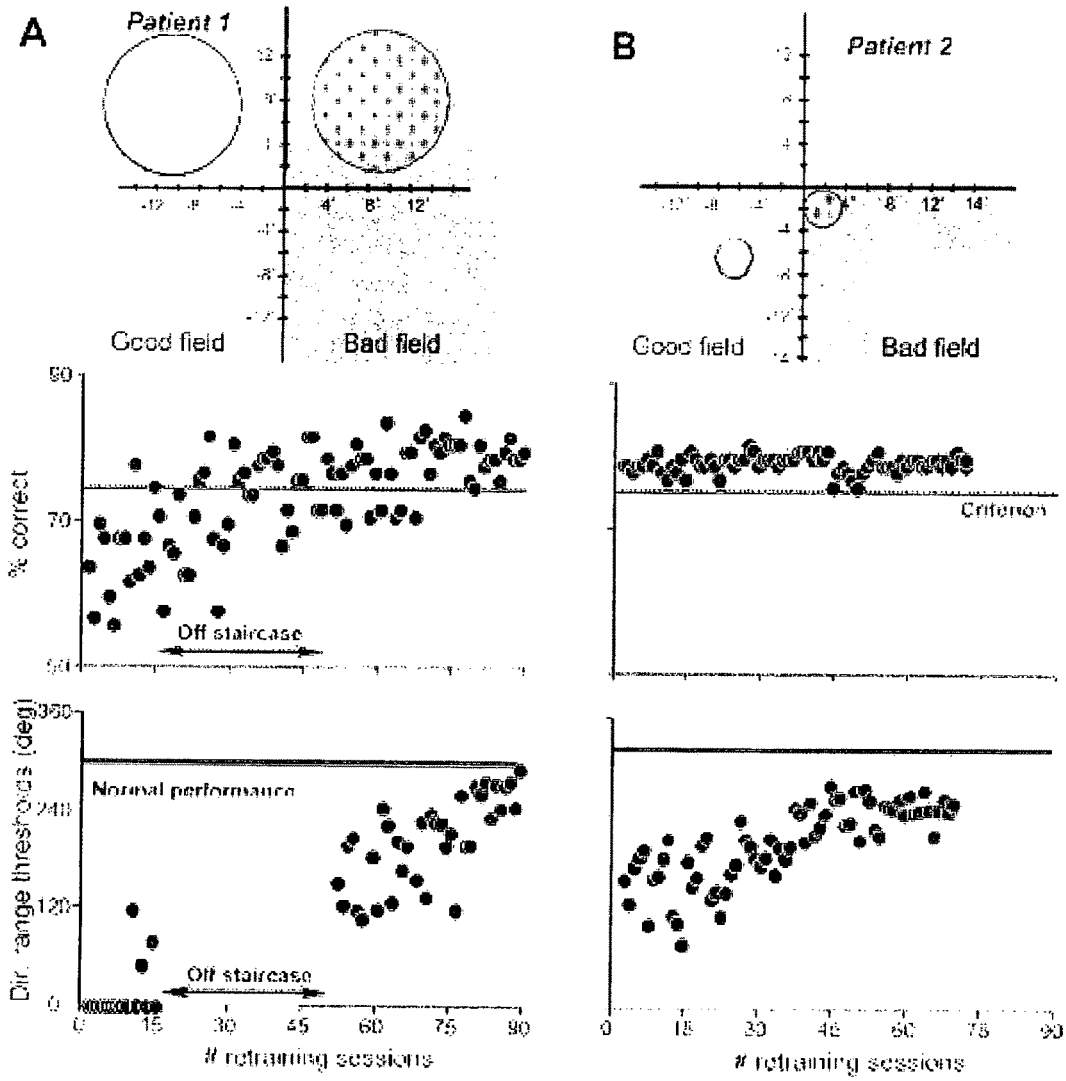
FIGS. 13A-13B provide retraining-induced recovery of direction range thresholds for Patients 1 and 2.

As shown in FIG. 13, both patients improved gradually until they reached near normal (Patient 2, FIG. 13B) or normal (Patient 1, FIG. 13A) direction range thresholds. FIG. 13A provides visual retraining and recovery data for Patient 1. B. FIG. 13A provides visual retraining and recovery data for Patient 2. The top diagrams in both cases are maps of the patients' visual fields with grey shading representing the visual field deficits measured using Humphrey perimetry. Axes are labeled in deg of visual angle. Hatched circles represent the location and size of random dot stimuli used for retraining. Grey circles denote random dot stimuli used to collect control data from intact portions of the visual field (grey lines and shading in bottom graphs). Circles in middle graphs plot percentage correct performance at hatched locations versus the number of training sessions. Note that Patient 1 started with much poorer (chance) performance than Patient 2 (~80% correct). Patient 1 needed 60 sessions to perform at 75% correct (criterion). To consolidate his retraining, he was taken off the staircase procedure (double-headed arrows), until his % correct when the range of dot directions was 0° (i.e., all dots moved coherently to the left or right) reached 75%. Only then was he allowed to view stimuli with a range of dot directions presented on the staircase. Direction range thresholds versus the number of training sessions are plotted on the two bottom graphs. Patient 1 reached normal direction range thresholds after about 90 training sessions. Patient 2's direction range thresholds improved faster, but they stabilized below her normal performance level (grey line and shading), as measured at grey circle in her good field.

However, note that this recovery required 60-90 training sessions, with patients performing 300 trials of this discrimination task per session, which equates to 18,000 to 27,000 trials in order to attain recovery. Patient 2 required only 60 sessions to recover (as opposed to 90 sessions for Patient 1) but then, she also started with a lesser deficit than Patient 1 (direction range thresholds of 165° versus 0°). Interestingly, and unlike Patient 1, Patient 2 also stabilized at a lower threshold than normal (as determined from performance in intact visual field quadrants). We hypothesize that this might be due to the fact that Patient 2 has more extrastriate cortical damage involving the dorsal stream, including areas V2 and possibly V3, than Patient 1 (see MRI scans in FIGS. 7 and 8). Area MT was intact in both patients, but it seems that Patient 2 might have damage to some of its feeder areas (V2 and V3) in addition to her V1 damage. Although we need more evidence to make a strong case for this, our preliminary results support the notion that the amount of complex motion perception recovered following V1 lesions might be limited by the amount of extrastriate visual cortical damage sustained, particularly to feeder areas or areas of the dorsal visual stream.

An important issue when measuring perceptual thresholds during retraining is whether patients are at all aware of their improvements. It would certainly be possible for hemianopic patients to remain unaware of their improvements, since neural networks in the dorsal pathway, which should be optimally stimulated by our retraining paradigm, are also specialized for visuomotor control rather than. Therefore, we asked both patients to provide written commentaries as they were doing their daily training sessions at home. Both of them reported progressively increasing awareness of the visual stimulus as their direction range thresholds improved (e.g., see Table 1 for details of Patient 2's visual experiences). When patients were first tested at blind field locations chosen for retraining, they reported sensing a stimulus, but could not tell that it was moving or that it was made of dots. With training, a sensation of motion first appeared, followed by the ability to extract a global direction of motion for the stimulus that was coincident with the patients' first report of seeing a small proportion of the dots closest to their intact field. Initially, this global directional percept was often wrong, but it improved with training. Note that as reported in Table 1, Patient 2 eventually reported seeing the entire random dot stimulus, but only when her direction range thresholds reached near-normal levels. Thus, awareness of training stimuli grew stronger and more complex as training progressed, paralleling improvements in motion sensitivity.

TABLE 1

Increasing conscious perception of visual stimuli as direction range (DR) thresholds improve in Patient 2.

| Week | DR threshold (mean + SEM)° | Patient Reports |
|---|---|---|
| 1 | 151 + 18 | Aug. 3, 2003: "I was able to see still only some of the dots, ⅛ to ¼ of them occasionally some at the top right side." |
| 2 | 184 + 16 | Aug. 16, 2003: "I can see ⅛ to ¼ of the stimuli." |
| 3 | 176 + 11 | Aug. 26, 2003: "I can see the left side of the stimuli, sometimes some at the top. I feel fairly well, sometimes needing to guess." |
| 4 | 193 + 5 | Sep. 7, 2003: "I seem to realize when I gave the wrong answer (at times when I thought answer) that I could actually tell which direction was correct." |
| 5 | 233 + 8 | Sep. 17, 2003: "I seem to be able to see direction of dots better. Instead of ⅛-¼ more ¼-½ that I was seeing." |
| 6 | 259 + 7 | Sep. 20, 2003: "Sometimes I can see the whole circle of dots even though I may clearly. Sometimes I am finding that I may close my eyes momentarily to picture I am seeing before answering." |
| 7 | 251 + 9 | Oct. 11, 2003: "I can see, most of the time, the full shape of the circle of dots." |

Figure 14:
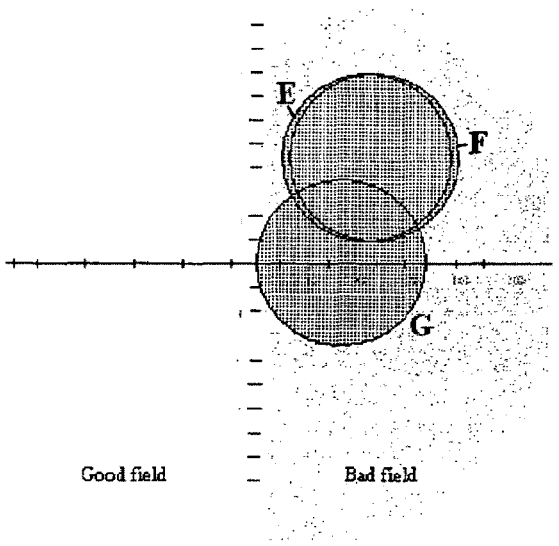
FIG. 14 illustrates the locations of the recovered areas compared to the locations and sizes of the retraining stimuli.

Once direction range thresholds improved and stabilized in both patients, we mapped performance at several other locations within the blind field to determine if visual recovery had spread beyond the boundaries of the retrained locations. As shown in FIG. 14, this was not the case. In fact, recovery of direction range thresholds was spatially restricted to the visual field locations retrained. The left diagram represents the visual field maps for Patient 1, with grey shading representing regions of abnormal visual performance as measured by Humphrey perimetry. The circle F illustrates the size and position of retraining stimuli used to induce recovery of direction range thresholds (see below and FIG. 15). The circles labeled E and G denote the visual field locations and sizes of stimuli used to test direction range threshold following recovery at location F. As indicated in the table in FIG. 14, direction range thresholds remained severely abnormal at locations E and G, in spite of significant overlap with the retrained locations. This suggests not only that recovery of direction range thresholds did not spread beyond the visual field location covered by the retraining stimulus for these patients. The failure to transfer the recovered performance to other stimulus locations, even those that overlapped significantly with the retrained location, showed that these patients recovered complex motion perception in only a portion of the visual field covered by the retraining stimulus.

Figure 15:
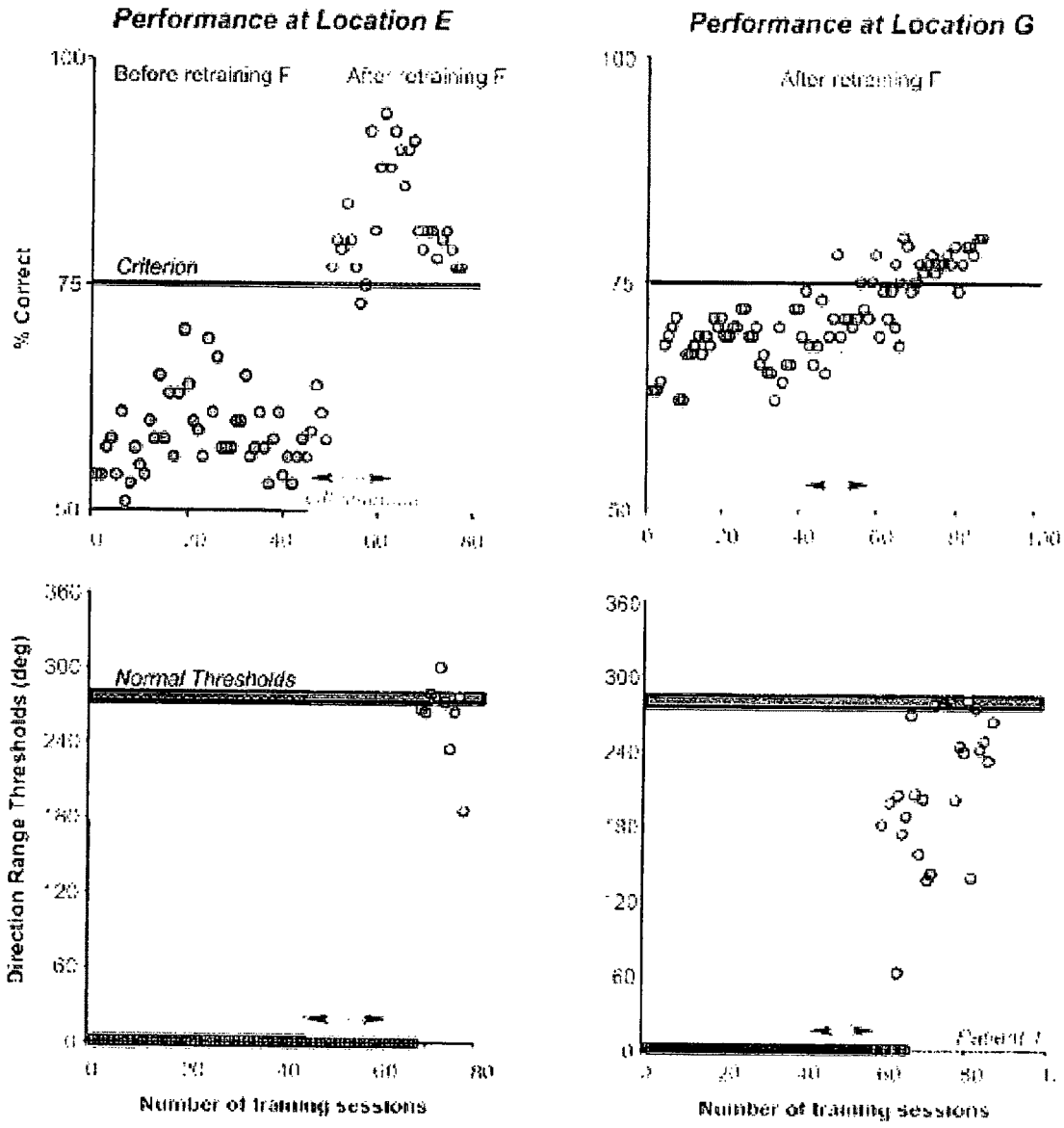
FIG. 15 illustrates "bootstrapping" in the retraining of Patients 1 and 2.

However, once we began training at the new visual field locations (for example, E and G for Patient 1), we were able to induce recovery of direction range thresholds. For example, FIG. 15 provides evidence of bootstrapping of training-induced recovery at two locations within the blind visual field of Patient 1. The plots are of % correct performance (top graphs) and direction range thresholds (bottom graphs) versus number of training sessions. Performance was measured at locations E and G before and after training-induced recovery at F (FIG. 14).

Interestingly, in Patient 1, we had unsuccessfully attempted to retrain vision at Location E before retraining location F (see above and FIG. 11D). We spent 44 training sessions at E with no improvement either in % correct or direction range thresholds (grey shading in FIG. 15). However, after recovering direction range thresholds at location F, we were able to induce rapid improvement of direction range thresholds at location E within about 25 sessions (white background in FIG. 15). Therefore, retraining at location F potentiated retraining at location E, a phenomenon we will refer to as "perceptual bootstrapping."

We then started measuring the optimal distance between a new visual field location and one where visual performance is normal or has been retrained, in order to exhibit bootstrapping and recovery. Our preliminary data suggest that this distance is from about 0.5° to about 1° visual angle, depending on the particular patient. Without being bound by any theory, our working hypothesis is that retraining induces connectional reorganization within (and probably between) intact visual cortical areas, starting with neurons that receive input from the border of the blind field region. Once intensive retraining optimizes and stabilizes the connections made by these "border" neurons with ones that normally respond to locations 0.5° deeper into the blind field, a new border is formed, shrinking the size of the blind field. In turn, these newly recruited neurons can be stimulated to become the new "border" neurons by moving the retraining stimulus deeper into the blind field. If the stimulus is moved too far (e.g., more than about 1°) into the blind field, it will not stimulate these newly recruited neurons and no recovery is induced.

Figure 9:
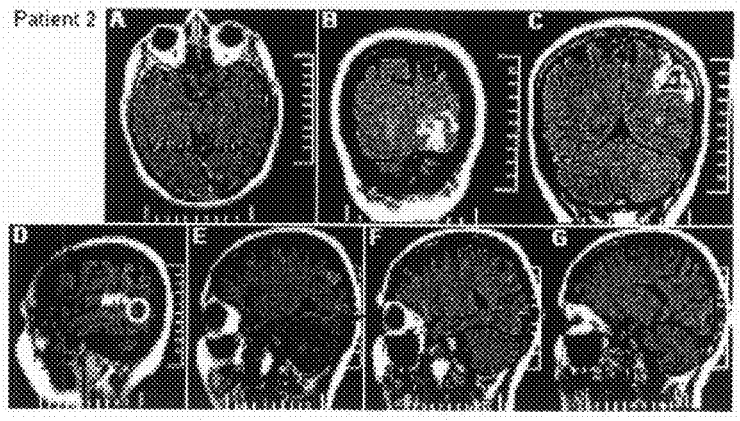
FIG. 9A-FIG. 9G are T1-weighted MRI scans of Patient 2's multiple brain lesions.

Effects of visual training on humphrey perimetry. Once training-induced recovery of direction range thresholds occurred at least at one location in both patients, Humphrey fields were repeated. FIG. 9 provides Humphrey visual field results collected before and after retraining on direction discrimination of random dot stimuli and recovery of near-normal direction range thresholds at visual field locations E, F, and G. Foveal performance was comparable pre- and post-training, ranging from 34 dB to 39 dB. The numbers in the dashed region showed significant improvement after retraining. For Patient 1, locations circled with a solid line showed improvement but were not directly exposed to a retraining stimulus. None of the numbers in the dashed region for Patient 2 corresponded to locations directly exposed to the retraining stimulus.

Both patients exhibited improved sensitivity in visual field regions circled in the dashed regions. In Patient 1, this improvement was partly co-incident with the region of the upper visual field that was retrained. No improvement in sensitivity was noted in his lower right quadrant, where no retraining had been administered. In Patient 2, the improvement was observed in the lower visual field where retraining had been administered, but it was located at a greater eccentricity than the retrained location F (see FIGS. 12 and 13). Thus, for Patient 2, Humphrey perimetry was not sufficiently sensitive to detect her improvement in visual motion perception at the specific location retrained. Even in Patient 1, Humphrey fields revealed an improvement in sensitivity to light in the far upper right quadrant, at more than 20° eccentricity (ovals in FIG. 10), which was not directly exposed to any of the retraining stimuli. Perhaps retraining patients to perform visual discriminations or simply asking them to attend to visual stimuli in blind portions of their visual field causes a generalized improvement in light detection that extends outside the boundaries of the stimulus. Possible neural substrates for this training-induced, distributed increase in sensitivity could include disinhibition or an increase in the excitatory/inhibitory ratio in extrastriate and/or subcortical neural networks that process visual information from these regions of the visual field and whose activity is depressed as a result of the V1 lesion.

Visual training improves visually-guided behavior in patients with cortical strokes.

Two tasks, a basketball task and a block-building task, were administered once before the onset of training with random dots, and once after recovery of direction range thresholds at a minimum of one blind field location (more than 12 months of training for Patient 1 at several locations and 6 months of training for Patient at a single location). Details of the basketball task are discussed above.

Basketball Task. This virtual reality program simulated the inside of Penn Station and required patients to detect and track with the eyes individual basketballs that appear at random locations throughout their visual field (FIG. 6). The balls drift at about 20 deg/sec towards the patients' head and disappear just before impact. Patients were asked to track the basketballs as soon as they could possibly detect them under three different conditions: (1) stationary with no restrictions on gaze, (2) stationary and fixating a given location in the scenery to control for hemianopes' tendency to fixate eccentrically and continuously scan across the visual field; and (3) walking an L-shaped path in the station, with no restrictions on gaze. The video data was analyzed frame by frame to establish the time points and visual field locations at which: (1) patients first detected each ball's presence (defined as the fixation location in the frame just before the frame when the patient began to saccade towards the ball), (2) patients first fixated a part of the ball and (3) the ball disappeared.

Figure 16:
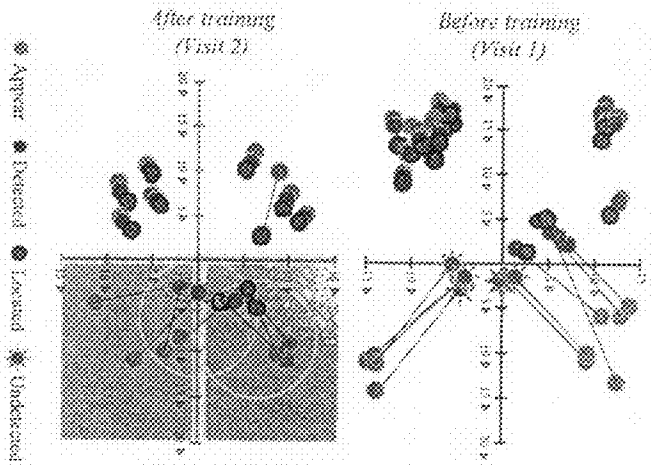
FIG. 16 provides results for Patient 1 on the basketball task before and after retraining.

FIG. 16 provides these data for Patient 1, both before and after retraining on direction range thresholds at locations E, F and G. Practice-related changes in performance on both tasks, as assessed by measuring changes in performance between first and second visits in intact portions of the visual field, were small. This was probably due to the large time interval between the two testing sessions. It was also noted that the patients' ability to detect and track basketballs while walking an L-shaped path in the virtual environment was very poor, even for balls that appeared in the intact hemifields. It seems that the attentional demands of walking significantly impaired the ability to attend to looming basketballs. However, when patients were stationary in the virtual environment and could devote their attentional resources to detecting and tracking basketballs, there a clear difference in performance between blind and intact regions of the visual field with both patients unable to detect and track basketballs within blind portions of their visual field prior to retraining, unless the balls crossed into their intact fields. This was in contrast to their rapid and accurate eye movements to balls that appeared and moved within intact portions of their visual field. After discrimination training with random dots, both patients regained their ability to detect and track basketballs within part of their blind field when stationary in the virtual environment.

The data for Patient 1 illustrates this point well. Before training, he was able to detect and track 0% of the balls that appeared in the upper right quadrant. After training, he was able to detect and track 80% of the balls that appeared in his (retrained) upper right quadrant before they crossed into his good field. His performance in the lower right (untrained) blind quadrant, however, was unchanged, i.e., he detected and tracked none of the balls that appeared there. All successful detections in the right upper quadrant were located within from about 5° to about 10° of the vertical meridian and from about 5° to about 10° above the horizontal meridian, which corresponds well to visual field locations that were exposed to random dot stimuli during retraining.

Example 2

Figure 17:
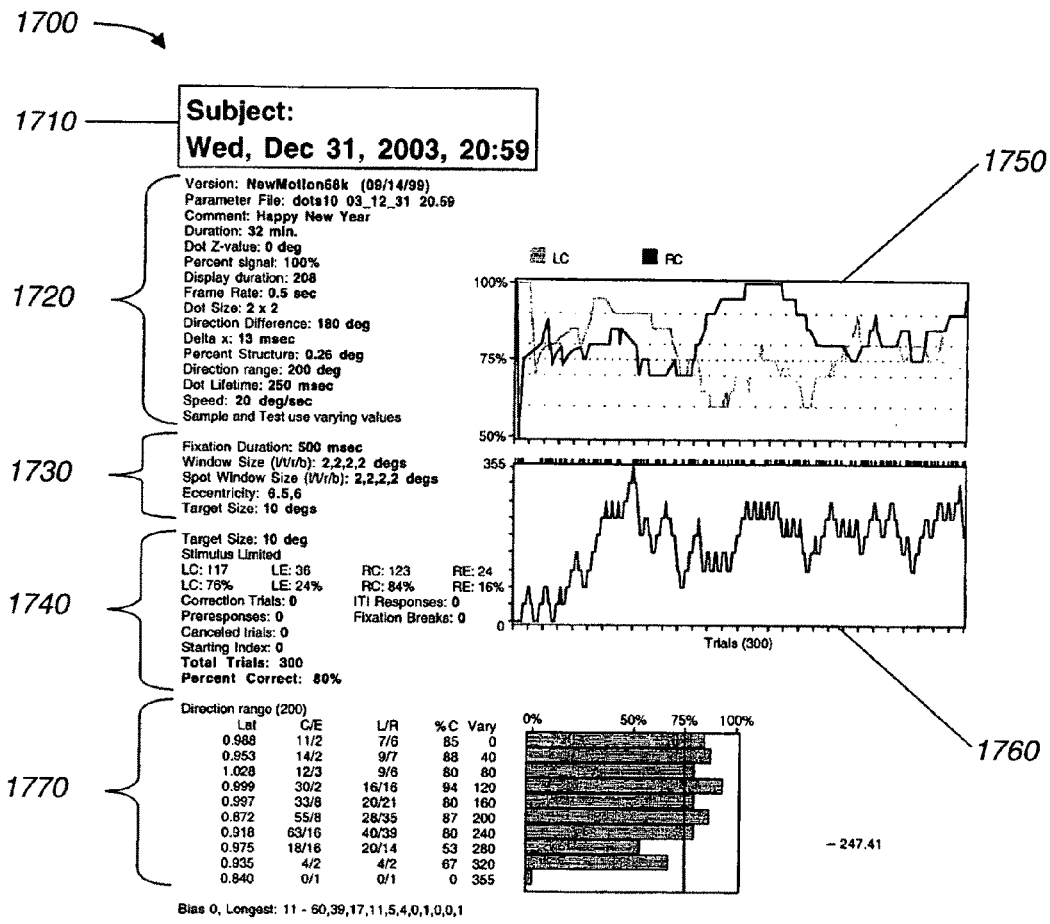
FIG. 17 depicts an exemplary data file of a training system.

FIG. 17 is an exemplary data file 1700 used in step 120 of the training system. The illustrated file includes data and/or parameters that is not included in other embodiments of data files. Furthermore, other embodiments include data and/or parameters not present in the illustrated embodiment. The illustrated embodiment includes a block 1710 for the subject's name or other identifier and the date and time of the retraining session. Block 1720 includes the software version, the name of the file containing the parameters for the retraining session, the duration of the session, and the parameters for the visual stimulus used in the session, which in this example, is a random dot stimulus. In particular, the stimulus has 208 dots, where each dot is 2×2 pixels, no noise dots (100% signal), and moves left and right. (Direction Difference: 180°). Block 1730 includes the parameters for the gaze fixation, the location of the stimulus in relation to the fixation spot (6.5°, 6°), and the size of the stimulus (10°).

Block 1740 includes the results for trials, where "LC" represents the correct responses for leftward moving stimuli as a raw number and as a percentage, "LE" is the number erroneous responses for leftward moving stimuli as a raw number and as a percentage, and RC and RE are the corresponding values for rightward moving stimuli.

The graph 1750 includes cumulative correct percentages for left moving (grey line) and right moving (black line) stimuli as the retraining session progresses. The graph 1660 indicates the level difficulty of each stimulus in units of direction range over the course of the session.

The table and graph 1770 provide data on the accuracy of the response for each direction range, where "Lat" is latency between the display of the visual stimulus and the subject's response in seconds, "C/E" is the number of correct and erroneous responses, "L/R" is the number of leftward and rightward stimuli, "% C" is the number correct, and "Vary" is the direction range of the stimulus. To the right of the graph is the direction range threshold for this session of 247.41° with a 75% correct criterion.

Fitting these data to a Weibel function provides the following coefficients: $\alpha$=105.9961, $\beta$=7.3963, and $\gamma$=0.8611. The direction range threshold calculated using the Weibel function for this retraining session is 246.1164° with a 75% correct criterion.

Alternative Embodiments of Vision Retraining System:

Other embodiments of the invention include a vision retraining system for human patients that utilizes visual modalities other than, or in addition to, direction range measurements in a direction discrimination task. For example, in one embodiment, a vision retraining system uses dynamic visual stimuli, such as a random dot kinematogram, to test visual discrimination of one or more of the following characteristics of the random dots: density, size, intensity, luminosity, color, shape, texture, motion, speed, global direction, noise content, combinations of the same and the like. The vision retraining system may utilize multiple visual modalities at the same time or may test and/or present for therapy only one visual modality at a time. In yet other embodiments, the vision retraining system may utilize other forms of dynamic visual stimuli or other types of discriminations instead of, or in addition to, random dot stimuli. For example, the vision retraining system may utilize orientation, direction, speed discrimination of sine wave gratings; letter/word identification; number identification; and/or shape/face/color discrimination.

In one embodiment, the vision retraining system comprises program logic usable to execute and/or select between the above-identified visual modalities. For example, the program logic may advantageously be implemented as one or more modules. The modules may advantageously be configured to execute on one or more processors. The modules may comprise, but are not limited to, any of the following: hardware or software components such as software object-oriented software components, class components and task components, processes, methods, functions, attributes, procedures, subroutines, segments of program code, drivers, firmware, microcode, applications, algorithms, techniques, programs, circuitry, data, databases, data structures, tables, arrays, variables, combinations of the same or the like.

Furthermore, use of embodiments of the invention is not limited to treat post-stroke patients. Rather, embodiments of the invention may also be used with patients that suffer from visual disabilities, including diseases and/or conditions that affect the optic nerve. For example, embodiments of the invention may be used to map, test, and/or retrain vision of patients suffering from glaucoma, optic atrophy, neurodegenerative diseases that affect the visual tracts (e.g., multiple sclerosis), and the like.

Without being bound by any theory, the following is believed to provide a basis for the disclosed training system. Subjects retain residual, largely unconscious visual perceptual abilities in the impaired visual fields. It is believed that select neurons survive within areas corresponding to the V1 lesion, and that some of these neurons project directly to the extrastriate (higher level) visual cortical areas. It is also believed that other neural pathways survive that bypass the damaged region. The retraining method and system disclosed herein is believed to recruit these surviving neurons to at least partly recover conscious vision in the affected areas, for example, motion perception.

1. In some embodiments, the visual retraining system preferentially stimulates higher order visual cortical areas to induce recovery of conscious and/or unconscious visual perception after damage to low-level and/or high-level areas of the visual system. In this step, a subject is presented with one or more visual stimuli. As discussed above, some retraining methods use small visual stimuli, for example, static spots of light. Accordingly, some embodiments use one or more stimuli with at least one or more of the following properties. In some preferred embodiments, the stimuli comprise substantially all of these properties.

Some embodiments use relatively large, spatially distributed stimuli positioned within the subject's blind field. In some embodiments, at least one of the stimuli is substantially circular with visual angle diameter of at least about 3°, about 4°, or about 5°.

In some embodiments, the stimulus has a particular attribute that the subject is asked to discriminate. For example, in some embodiments the stimulus has some combination of a particular color, shape, size, direction, speed, or the like. As discussed above, in some other retraining methods, the subject or patient is simply instructed to detect the presence of a stimulus rather than discriminating an attribute.

In some embodiments the stimuli are dynamic, for example, motion; speed; changes in motion, speed, size, shape, or color; or combinations thereof. As discussed above, in some other retraining methods, the stimuli are static.

In some embodiments, the stimuli are complex, meaning that they require processing by higher levels of the visual system than primary visual cortex (V1), thereby permitting the subject to extract the discriminatory information. Such stimuli include, for example, random dot stimuli in which directional noise is being introduced or in which the directional signal to noise ratio is decreased while subjects are trying to extract a global direction of motion for the whole stimulus. As discussed above, in some retraining methods, the stimuli are simple.

In some embodiments, confounding effects of light scatter are minimized. For example, some embodiments use stimuli with reduced contrast compared with the background. For example, in some embodiments, the stimulus is grey on a white or bright background. In some preferred embodiments, the subject performs the tests in a well-lit rather than a dark room. As discussed above, in some other retraining methods, the stimuli are white spots on a dark field, and the test is typically performed in a darkened room.

In some embodiments, the standard for recovery of the retrained visual field location is attainment of normal sensitivity thresholds. In these embodiments, it is not sufficient for a subject to perform at 70% or greater on the task. Preferably, the subject possesses normal discrimination thresholds, which again, requires more complex processing by the visual cortical system.

In some preferred embodiments, a subject recovers normal thresholds at one visual field location before the stimulus is moved deeper into the blind field, whereupon he/she undergoes retraining at this new location.

Rationale: Patients who suffer visual strokes, for example, affecting primary visual cortex (V1), exhibit blindness in portions of their visual field that is largely believed to be permanent after about the first 2-3 months, despite the fact that these patients usually have intact higher-level visual cortical areas that could potentially process visual information. These higher-level visual cortical areas do not appear to process visual information in a meaningful way, however, because this information does not typically reach consciousness and is, consequently, not of much use to the patient. Higher-level visual areas are known to process more complex aspects of the visual information, for example, motion, shape, faces, object, and/or letter recognition. For example, published fMRI studies indicate that complex visual stimuli and/or task requirements tend to activate higher level visual cortical areas more often and more strongly compared with simple visual stimuli.

Compared with other rehabilitation therapies, some embodiments include a visual retraining method in which patients discriminate complex visual stimuli repeatedly. For example, in some embodiments, the patient undergoes from about 300 to about 500 trials per day. In some preferred embodiments, all of the trials are performed in substantially a single session each day. In some preferred embodiments, one or more retraining sessions are performed every day for a predetermined time period. In other embodiments, the retraining sessions are continued to until the patient achieves a desired endpoint.

It is believed that this methodology forces the cortical visual system to interpret the visual information it receives, and to form and/or to change synaptic connections necessary to process this information in a meaningful way, thereby compensating at least partially for the cortical circuitry lost as a result of the brain damage. Finally, it is believed that using dynamic rather than static stimuli and having the patient discriminate complex motion attributes further enhances the visual recovery, especially after damage to primary visual cortex. Because motion sensitivity is pervasive throughout higher-level visual cortical areas, a significant amount of sensitivity to motion is likely to be preserved following damage to a single part of the visual system. This motion sensitivity is likely to be masked following the lesion, but can be unmasked if the visual system is stimulated in such a way as to reveal it.

For patients suffering from damage to higher-level visual cortical areas, the same retraining system believed to stimulate the reorganization of connectional networks in intact visual areas. Evidence of such a mechanism has been observed in cats, for example, as reported in Huxlin and Pasternak, 2004, the disclosure of which is incorporated by reference.

2. Retrained portions of the visual field are believed to act as seeding areas to enable training-induced recovery at adjacent, previously blind areas where retraining was previously ineffective. This phenomenon is referred to herein as "bootstrapping."

Rationale: Preliminary data in three adult human patients with strokes of the primary visual cortex show that visual recovery is specific to those portions of the visual field where the retraining stimuli were presented. We have discovered that once a portion of the visual field has been retrained, it is then possible to use that region as a seeding area for retraining adjacent areas of the visual field where retraining was previously ineffective. It is believed that this is due to the spatially extended nature of the stimulus used in some embodiments disclosed herein, for example, a circular area containing moving dots of from about 4° to about 12° visual angle in diameter rather than a small spot of light as in the NovaVision VRT.

It is believed that in embodiments using, for example, the circular stimulus, in order for the cortical visual system to extract the information for answering the question, "What direction is the whole stimulus moving in?" it needs to process directional information from a large portion of the circular stimulus, not just a single dot. Consequently, in the brain, neurons responding to different parts of the visual field need to be activated and involved in the processing. It is believed that placing this circular stimulus at the border between the intact and impaired regions of the visual field forces neurons that may have been rendered inactive by the lesion, whether directly or indirectly, to become active again and participate in processing of the stimulus. Once these neurons are recruited into the active/functional circuitry, they can in turn be used to recruit additional neurons, located farther into the impaired visual field by moving the stimulus deeper into the impaired visual field.

3. Measuring visual performance, for example, eye movements, in virtual reality and in real life as a means of safely and quantitatively assessing whether patients who show recovery of normal visual discrimination thresholds following visual retraining described above. In some embodiments, these measurements are used to determine if the patients actually use this recovered perceptual ability in everyday life situations. In some embodiments, these measurements are also used to assess the effectiveness of visual retraining in patients with brain damage, particularly when these patients are retrained on the complex motion discrimination tasks discussed herein. As discussed herein, in some embodiments, virtual reality is useful as a retraining tool for certain types of visual disorders.

Rationale: As has been described in the literature, eye movements during visual search or the performance of an action are useful in assessing the kind of visual information subjects need and use to perform that action. Improvements in visual performance have been assessed using visual field perimetric tests, for example, Humphrey perimetry, Tubingen perimetry, Goldman perimetry, and/or high resolution perimetry, perimetry is generally ineffective for evaluating how well patients are able to use visual information in everyday life, which is a complex, three-dimensional, moving environment. Consequently, we endeavored to develop such a test, in particular, because in the retraining method disclosed herein, subjects perform complex motion discrimination tasks. The test measures gaze distributions in subjects while they are performing a task and navigating in either virtual reality or the real world. This test has proven to be a sensitive measure of the usage of visual information in complex, three-dimensional, dynamic environments.

While certain embodiments of the inventions have been described, these embodiments have been presented by way of example only, and are not intended to limit the scope of the inventions. Indeed, the novel methods, concepts and systems described herein may be embodied in a variety of other forms; furthermore, various omissions, substitutions and changes in the form of the methods, concepts and systems described herein may be made without departing from the spirit of the inventions.

What is claimed is:

1. A method, for evaluating or improving a visual system of a subject, comprising:

displaying a first visual stimulus within a first location of a visual field of the subject; and receiving input from the subject indicating the subject's visual cortical perception of a global direction of motion of the first visual stimulus.

2. The method of claim 1, further comprising retraining the visual system by displaying multiple subsequent visual stimuli to the subject over a time period, after displaying the first visual stimulus, such that an area of an impaired visual field of the subject decreases over the time period.

3. The method of claim 2, wherein the retraining occurs over multiple sessions during the time period.

4. The method of claim 1, further comprising evaluating the visual system by:

displaying multiple subsequent visual stimuli to the subject over a time period, after displaying the first visual stimulus;

receiving subsequent inputs from the subject indicating the subject's perception of a direction of motion of at least some of the multiple subsequent visual stimuli; and mapping the subsequent inputs to a visual-field-coordinate system to determine whether and/or where a portion of the subject's visual field is impaired.

5. The method of claim 4, wherein the evaluating occurs during a single session in the time period.

6. The method of claim 1, wherein the input comprises an indication of the direction.

7. The method of claim 1, further comprising determining whether the visual field is impaired at the first location.

8. The method of claim 2, further comprising mapping a first impaired visual-field region and a second impaired visual-field region, wherein the first and second impaired visual-field regions are non-overlapping, and the first impaired visual-field region is retrained and the second impaired visual-field region is a control.

9. The method of claim 4, wherein the mapping comprises perimetry.

10. The method of claim 2, wherein at least a portion of the retraining is performed in a virtual reality environment.

11. The method of claim 2, wherein at least a portion of the retraining is performed in a real environment.

12. The method of claim 1, wherein the visual stimulus comprises a random dot stimulus, and the direction of motion comprises a net direction of motion of multiple dots in the random dot stimulus.

13. The method of claim 12, wherein a direction range of the dots is between about 0° and about 355°.

14. The method of claim 1, wherein a visual angle diameter of the visual stimulus is from about 4° to about 12°.

15. The method of claim 1, wherein the visual stimulus is displayed on a background that is brighter than the overall brightness of the visual stimulus.

16. The method of claim 1, wherein input from the subject is received from a keyboard.

17. A system, for evaluating or improving the visual system of a subject, comprising:

a display configured for displaying a visual stimulus within a first location of a visual field of a subject;

a data input device that receives input from the subject indicating the subject' visual cortical perception of a global direction of motion of the visual stimulus; and a data processing unit that outputs a visual-field representation of the first location based on the input from the subject.

18. The system of claim 17, further comprising stored machine-readable instructions that provide instructions to the display regarding the visual stimulus.

19. The system of claim 17, wherein the data input device comprises a keyboard for receiving the input from the subject.

20. The system of claim 17, wherein the display comprises a background that is brighter than the overall brightness of the visual stimulus.

21. The system of claim 17, further comprising a virtual reality module for displaying the visual stimulus in a virtual reality environment.

22. The system of claim 17, further comprising a head positioning device for aligning a subject's eye with the display.

23. A method, for mapping the visual field of a subject, comprising:

displaying a visual stimulus on a background within a first location of the visual field of the subject, wherein the visual stimulus is darker than its immediate background;

receiving input from the subject relating to the subject's visual cortical of the perception of a global direction of motion of the visual stimulus; and based on the input, determining whether the visual field is impaired at the first location.

* * * * *